US009095871B2

(12) United States Patent
Vogt et al.

(10) Patent No.: US 9,095,871 B2
(45) Date of Patent: Aug. 4, 2015

(54) CARTRIDGE SYSTEM AND DISPENSING TUBE FOR SAID CARTRIDGE SYSTEM

(75) Inventors: Sebastian Vogt, Erfurt (DE); Hubert Büchner, Nürnberg (DE)

(73) Assignee: Heraeus Medical GmbH, Wehrheim (DE)

( * ) Notice: Subject to any disclaimer, the term of this patent is extended or adjusted under 35 U.S.C. 154(b) by 325 days.

(21) Appl. No.: 13/096,260

(22) Filed: Apr. 28, 2011

(65) Prior Publication Data

US 2011/0272436 A1 Nov. 10, 2011

(30) Foreign Application Priority Data

May 4, 2010 (DE) ..... 10 2010 019 217

(51) Int. Cl.
*B67D 7/78* (2010.01)
*B05C 17/005* (2006.01)
(Continued)

(52) U.S. Cl.
CPC ..... *B05C 17/00553* (2013.01); *B01F 5/061* (2013.01); *B01F 13/0023* (2013.01);
(Continued)

(58) Field of Classification Search
CPC .. B29B 7/7663; B29B 7/7678; B67D 1/0044; B65D 81/325; B05C 17/00553; B01F 13/0023; B01F 15/0237
USPC ..... 222/135, 386.5, 386, 544, 547, 554, 222/563, 145.5–145.6, 389, 136–137; 433/90
See application file for complete search history.

(56) References Cited

U.S. PATENT DOCUMENTS 1,092,433 A * 4/1914 Cox ..... 222/144.5
1,308,091 A 7/1919 Maurer
(Continued)

FOREIGN PATENT DOCUMENTS

AU 653201 B2 9/1994
CH 669164 A5 2/1989
(Continued)

OTHER PUBLICATIONS

Computer-generated, English-Language Translation of Japanese Office Action for related Japanses Application No. 2011-103859 dated Jan. 25, 2013.
(Continued)

*Primary Examiner* — Kevin P Shaver
*Assistant Examiner* — Robert Nichols, II
(74) *Attorney, Agent, or Firm* — Norris McLaughlin & Marcus, P.A.

(57) ABSTRACT

A cartridge system mixes and applies a mixing ware, such as, for example, a medical cement. The cartridge system has two cartridges that are arranged parallel to each other, and a mixing space having an outlet opening, wherein the cartridges each comprise at least one opening in the cartridge walls that connects the cartridges to the mixing space. The cartridges each comprise a feed plunger for expelling starting components of the mixing ware out of the cartridges through the openings, wherein a closure that can be shifted in the mixing space is arranged in the mixing space in a manner such that it closes the openings of the cartridges in a starting position and in that the openings to the mixing space are opened, at least in part, in a final position of the shiftable closure, wherein the shiftable closure can be shifted from a starting position to a final position. A dispensing tube for the cartridge system has, opposite from a dispensing tube tip of the dispensing tube, an extension with a diameter is smaller than an internal diameter of the mixing space, and which is designed to shift the shiftable closure during the insertion of the dispensing tube into the cartridge system head of the cartridge system such that the openings of the cartridges are open, at least in part.

13 Claims, 11 Drawing Sheets

(51) Int. Cl.

| | |
|---|---|
| ***B65D 81/32*** | (2006.01) |
| ***B01F 5/06*** | (2006.01) |
| ***B01F 13/00*** | (2006.01) |
| ***B01F 15/00*** | (2006.01) |
| ***B01F 15/02*** | (2006.01) |

(52) U.S. Cl.

CPC ..... *B01F15/0087* (2013.01); *B01F 15/0237* (2013.01); *B05C 17/00506* (2013.01); *B05C 17/00513* (2013.01); *B05C 17/00516* (2013.01); *B65D 81/325* (2013.01); *B01F 2215/0029* (2013.01)

(56) References Cited

U.S. PATENT DOCUMENTS

| | | | | |
|---|---|---|---|---|
| 1,920,165 | A | 8/1933 | Andvig | |
| 2,125,245 | A | 7/1938 | McCray | |
| 2,446,501 | A | 8/1948 | Weber | |
| 2,694,506 | A | 11/1954 | Knapp | |
| 2,818,899 | A | 1/1958 | De Back | |
| 2,973,885 | A | 3/1961 | Ferguson | |
| 3,116,856 | A | 1/1964 | Prussin et al. | |
| 3,136,456 | A | 6/1964 | Sherbondy | |
| 3,215,298 | A | 11/1965 | Shaffer | |
| 3,282,473 | A | 11/1966 | Moore | |
| 3,570,719 | A * | 3/1971 | Schiff | 222/137 |
| 3,603,487 | A | 9/1971 | Cook | |
| 3,752,368 | A | 8/1973 | Robertson | |
| 3,768,472 | A | 10/1973 | Hodosh et al. | |
| 3,834,433 | A | 9/1974 | Thompson | |
| 3,938,709 | A | 2/1976 | Collar | |
| 3,983,947 | A | 10/1976 | Wills et al. | |
| 4,068,830 | A | 1/1978 | Gray | |
| 4,174,868 | A | 11/1979 | De Nardo | |
| 4,318,403 | A | 3/1982 | Sneider | |
| 4,386,717 | A | 6/1983 | Koob | |
| 4,432,469 | A * | 2/1984 | Eble et al. | 222/134 |
| 4,441,629 | A | 4/1984 | Mackal | |
| 4,634,027 | A | 1/1987 | Kanarvogel | |
| 4,676,410 | A | 6/1987 | von Flue | |
| 4,690,306 | A | 9/1987 | Staheli | |
| 4,846,373 | A | 7/1989 | Penn et al. | |
| 4,848,598 | A | 7/1989 | McKinney | |
| 4,871,088 | A | 10/1989 | Cox | |
| 4,925,061 | A | 5/1990 | Jeromson, Jr. et al. | |
| 4,967,797 | A | 11/1990 | Manska | |
| 4,981,241 | A | 1/1991 | Keller | |
| 4,989,758 | A | 2/1991 | Keller | |
| 5,027,981 | A | 7/1991 | Magister | |
| 5,072,862 | A | 12/1991 | Keller | |
| 5,080,262 | A | 1/1992 | Herold et al. | |
| 5,137,182 | A | 8/1992 | Keller | |
| 5,156,421 | A | 10/1992 | Chauvel | |
| 5,301,631 | A | 4/1994 | Vining | |
| 5,301,842 | A | 4/1994 | Ritter | |
| 5,361,946 | A | 11/1994 | Ginther et al. | |
| 5,441,175 | A | 8/1995 | Jacobsen et al. | |
| 5,443,182 | A | 8/1995 | Tanaka et al. | |
| 5,477,987 | A | 12/1995 | Keller | |
| 5,498,078 | A | 3/1996 | Keller | |
| 5,514,135 | A | 5/1996 | Earle | |
| 5,566,860 | A | 10/1996 | Schiltz et al. | |
| 5,667,102 | A | 9/1997 | Keller | |
| 5,890,628 | A | 4/1999 | Simpson et al. | |
| 5,893,486 | A | 4/1999 | Wasmire | |
| 5,894,869 | A | 4/1999 | Mussack | |
| 5,944,226 | A | 8/1999 | Schiltz et al. | |
| 5,968,018 | A | 10/1999 | Freeman et al. | |
| 6,029,857 | A | 2/2000 | Keller | |
| 6,077,138 | A | 6/2000 | Schulze | |
| 6,223,941 | B1 | 5/2001 | Nealey | |
| 6,296,149 | B1 | 10/2001 | Long | |
| 6,311,871 | B1 * | 11/2001 | Binder | 222/145.6 |
| 6,547,101 | B1 | 4/2003 | Sogaro | |
| 6,783,509 | B1 | 8/2004 | Landau et al. | |
| 6,935,541 | B1 | 8/2005 | Campbell et al. | |
| 7,163,130 | B2 | 1/2007 | Lafond | |
| 7,185,792 | B2 | 3/2007 | Gibbons et al. | |
| 7,188,753 | B2 | 3/2007 | Campbell | |
| 7,481,333 | B2 | 1/2009 | Goldberg et al. | |
| 7,530,808 | B2 | 5/2009 | Cao et al. | |
| 7,637,398 | B2 | 12/2009 | Sung | |
| 7,677,418 | B2 | 3/2010 | Henniges et al. | |
| 7,752,974 | B2 | 7/2010 | Wenaas et al. | |
| 7,845,517 | B2 | 12/2010 | Py et al. | |
| 7,963,937 | B2 | 6/2011 | Pauser et al. | |
| 8,016,161 | B2 | 9/2011 | Pierson et al. | |
| 8,028,858 | B2 | 10/2011 | Hollars | |
| 8,177,099 | B2 | 5/2012 | Suchan et al. | |
| 8,292,619 | B2 * | 10/2012 | Peuker et al. | 433/89 |
| 8,328,553 | B2 | 12/2012 | Broyles et al. | |
| 2001/0008968 | A1 | 7/2001 | Overes et al. | |
| 2002/0052579 | A1 | 5/2002 | Sogaro | |
| 2002/0146662 | A1 * | 10/2002 | Radl et al. | 433/90 |
| 2002/0188250 | A1 | 12/2002 | Landau et al. | |
| 2003/0179648 | A1 | 9/2003 | Heusser et al. | |
| 2004/0074927 | A1 | 4/2004 | Lafond | |
| 2004/0104249 | A1 | 6/2004 | Horth et al. | |
| 2004/0216591 | A1 * | 11/2004 | Assadi et al. | 89/1.14 |
| 2005/0150903 | A1 | 7/2005 | Py et al. | |
| 2005/0150916 | A1 | 7/2005 | De Laforcade | |
| 2005/0230433 | A1 | 10/2005 | Campbell | |
| 2005/0241703 | A1 | 11/2005 | Takacs | |
| 2005/0247740 | A1 | 11/2005 | Puzio | |
| 2005/0269368 | A1 | 12/2005 | Proulx | |
| 2006/0208000 | A1 | 9/2006 | Murray et al. | |
| 2007/0051750 | A1 | 3/2007 | Suchan et al. | |
| 2007/0164047 | A1 | 7/2007 | Reidt et al. | |
| 2007/0175921 | A1 * | 8/2007 | Keller | 222/137 |
| 2008/0086079 | A1 | 4/2008 | Williamson et al. | |
| 2008/0210708 | A1 | 9/2008 | Yeames | |
| 2008/0247262 | A1 | 10/2008 | Henniges et al. | |
| 2008/0287880 | A1 | 11/2008 | Keller | |
| 2008/0304355 | A1 | 12/2008 | Sattig et al. | |
| 2008/0314929 | A1 * | 12/2008 | Keller | 222/145.6 |
| 2009/0057338 | A1 | 3/2009 | Knee et al. | |
| 2009/0062808 | A1 | 3/2009 | Wolf, II | |
| 2009/0065532 | A1 | 3/2009 | Lafond | |
| 2009/0071459 | A1 | 3/2009 | Wenaas et al. | |
| 2009/0105144 | A1 | 4/2009 | Vogt et al. | |
| 2009/0105366 | A1 | 4/2009 | Vogt et al. | |
| 2009/0127289 | A1 | 5/2009 | Keller | |
| 2010/0200618 | A1 | 8/2010 | Dubach | |
| 2010/0213217 | A1 | 8/2010 | Strong et al. | |
| 2010/0319796 | A1 | 12/2010 | Whitaker | |
| 2011/0272436 | A1 | 11/2011 | Vogt et al. | |
| 2011/0272438 | A1 | 11/2011 | Vogt et al. | |
| 2011/0311730 | A1 | 12/2011 | Atsebha et al. | |
| 2012/0104050 | A1 | 5/2012 | Moessle | |
| 2013/0152855 | A1 | 6/2013 | Hartman et al. | |

FOREIGN PATENT DOCUMENTS

| | | | |
|---|---|---|---|
| CN | 101203327 | A | 6/2008 |
| DE | 2017292 | A1 | 10/1971 |
| DE | 3440893 | A1 | 5/1986 |
| DE | 3530212 | C1 | 10/1986 |
| DE | 91 02 635 | U1 | 5/1991 |
| DE | 9102635 | U1 | 7/1991 |
| DE | 297 09 383 | U1 | 10/1998 |
| DE | 20107507 | U1 | 3/2002 |
| DE | 20 2006 014087 | U1 | 12/2006 |
| DE | 102005041961 | A1 | 3/2007 |
| DE | 102006001056 | A1 | 7/2007 |
| DE | 202006015457 | U1 | 2/2008 |
| DE | 20 2008 009692 | U1 | 10/2008 |
| DE | 102007044983 | A1 | 4/2009 |
| DE | 102007052116 | A1 | 4/2009 |
| DE | 102007050762 | A1 | 5/2009 |
| DE | 202005010206 | | 9/2009 |
| DE | 102008030312 | A1 | 1/2010 |
| EP | 0028032 | A1 | 5/1981 |
| EP | 0169533 | A2 | 1/1986 |

(56) References Cited

FOREIGN PATENT DOCUMENTS

| | | | |
|---|---|---|---|
| EP | 0213073 | A1 | 3/1987 |
| EP | 0236129 | A2 | 9/1987 |
| EP | 0261466 | A1 | 3/1988 |
| EP | 0289882 | A1 | 11/1988 |
| EP | 0294672 | | 12/1988 |
| EP | 0431347 | | 6/1991 |
| EP | 0607102 | A1 | 7/1994 |
| EP | 0664153 | A1 | 7/1995 |
| EP | 0693437 | A1 | 1/1996 |
| EP | 0787535 | A1 | 8/1997 |
| EP | 1118313 | A1 | 7/2001 |
| EP | 15441223 | A1 | 6/2005 |
| EP | 2008707 | | 12/2008 |
| FR | 650 157 | A | 1/1929 |
| GB | 1188516 | A1 | 4/1970 |
| GB | 2195713 | A | 4/1988 |
| JP | 2003341749 | A | 12/2003 |
| JP | 2005289470 | A | 10/2005 |
| JP | 2009529377 | A | 8/2009 |
| JP | 2009 291234 | A | 12/2009 |
| WO | 2006005206 | A1 | 1/2006 |
| WO | 2008100130 | A2 | 8/2008 |
| WO | 2008109439 | | 9/2008 |
| WO | 2009036962 | A2 | 3/2009 |
| WO | 2009/061884 | A1 | 5/2009 |
| WO | 2010006455 | A1 | 1/2010 |

OTHER PUBLICATIONS

Chinese Office Action for co-pending U.S. Appl. No. 13/096,156 for related Chinese Application no. 201110113264.4 dated Feb. 4, 2013.

European Search Report Dated Sep. 13, 2011 for EP 11 00 3139 corresponding to U.S. Appl. No. 13/096,233.

European Search Report Dated Sep. 15, 2011, for EP Application No. 11 00 3130 corresponding to U.S. Appl. No. 13/096,105.

Canadian Intellectual Property Office, Office Action dated Aug. 1, 2012.

"Australian Search Report dated Jul. 28, 2012 for AU Application No. 2011201857 corresponding to related U.S. Appl. No. 13/096,260."

Australian Search Report for related AU 2011202037, mailed Aug. 16, 2012.

Notice of Allowance from related U.S. Appl. No. 13/096,233, mailed Aug. 1, 2013.

Notice of Allowance from related U.S. Appl. No. 13/096,156, mailed Aug. 26, 2013.

Final Rejection from related U.S. Appl. No. 13/096,105, mailed Aug. 28, 2013.

Non-Final Rejection from related U.S. Appl. No. 13/096,062, mailed Sep. 5, 2013.

Japanese Office Action for corresponding JP Application No. 2011-103862 dated Jul. 29, 2013 with English-Language Translation.

Chinese Office Action for co-pending U.S. Appl. No. 13/096,233 for related Chinese Application No. 201110113261.0 dated Nov. 21, 2013 with English-Language Translation.

Chinese Office Action for co-pending U.S. Appl. No. 13/096,105 for related Chinese Application No. 201110114686.3 dated Dec. 9, 2013 with English-Language Translation.

Non-Final Rejection from related U.S. Appl. No. 13/096,062, mailed Jun. 30, 2014.

* cited by examiner

CARTRIDGE SYSTEM AND DISPENSING TUBE FOR SAID CARTRIDGE SYSTEM

The invention relates to a cartridge system for mixing and applying a mixing ware, in particular a medical cement, comprising two cartridges that are arranged parallel to each other, and a mixing space having an outlet opening, whereby the cartridges each comprise at least one opening in the cartridge walls that connect(s) the cartridges to the mixing space, and the cartridges each comprise a feed plunger for expelling starting components of the mixing ware out of the cartridges through the openings, as well as a dispensing tube for a cartridge system of said type.

Cartridge system for mixing and applying a mixing ware can consist of multiple components and are to ensure safe storage and safe closure for components in at least two cartridges prior to their use. The cartridge system should be safe and easy to open right before the application of the mixing ware, whereby synchronous opening of the individual cartridges is desirable.

BACKGROUND OF THE INVENTION

Reactive pasty two- or multi-component systems must be stored separately after their production and until their application in order to prevent premature, inadvertent reactions of the components. Cartridge system for the application of pasty two- or multi-component systems have been known for decades. The following documents are cited for exemplary purposes, CH 669 164 A5, EP 0 607 102 A1, EP 0 236 129 A2, DE 3 440 893 A1, U.S. Pat. No. 4,690,306 A, US 2009/062808 A1, EP 0 787 535 A1, WO 2006/005 206 A1, EP 0 693 437 A1, EP 0 294 672 A, EP 0 261 466 A1, and EP 2 008 707 A1. The pasty two- or multi-component systems are mixed right before their application, usually through the use of static mixers. The following documents are cited for exemplary purposes, GB 1,188,516 A, U.S. Pat. Nos. 2,125,245 A, 5,968,018 A, 4,068,830 A, US 2003/179648 A1, EP 0 664 153 A1, and EP 0 289 882 A1. After the cartridges are filled with reactive pastes, the cartridges need to remain closed until their application. In this context, mobile plungers, which are also used to dispense the cartridge content, usually seal the cartridge floors.

A number of solutions has been proposed for closing the cartridge system head of the cartridge system.

One simple, but very effective, principle is to close the cartridge head with a closure that can be rotated (EP 0 431 347 A1, DE 2 017 292 A1, U.S. Pat. No. 3,215,298 A). The closure is unscrewed prior to the application. Subsequently, a dispensing tube is screwed into a thread on the cartridge head or fixed through a peg system that simulates a thread. This is disadvantageous in that the user needs to perform rotational motions twice until the paste material can be expelled. Moreover, the closure may be screwed out and the dispensing tube is attached only later. In the interim between the cartridges being opened and the dispensing tube being inserted, ingredients of the pastes may evaporate, especially if the pastes contain volatile substances.

The closure that is in very common use currently in the adhesives and sealant industry is based on the wall material of the cartridge being provided to be very thin at the cartridge head such that said wall can be perforated easily. During perforation, particles may become detached from the wall and can thus enter the pasty material.

The backside of the cartridges is usually closed by mobile plungers that are designed for expelling the pastes during application. In the case of humidity- and air-sensitive pastes, aluminium cartridges may be used that are closed by plastic plungers and over which aluminium cylinders that are closed on one side are pressed in for sealing purposes. During the application of the pastes, the aluminium cylinder having one closed side is moved jointly with the plunger towards the front in the direction of the cartridge head through the action of cartridge applicator guns and the paste is expelled in the process. However, any contact of paste and aluminium surfaces may be problematic in medical applications.

Using cartridge systems for sterile pasty medical products, there is a need for not only the pastes, but obviously the cartridges and secondary packaging means also to be provided in sterile form to the user. For example after aseptic filling of the previously sterilised cartridges, these may be transferred directly to sterile packaging means. Moreover, it may make sense for certain products to sterilise the surfaces of filled cartridges jointly with the packaging means after packaging is completed. Aside from gamma sterilisation, which cannot be used with paste systems that can be polymerised, there is the option to use ethylene oxide gas for sterilisation.

However, one issue of said sterilisation with gas in the case of paste systems containing monomers with a high vapour pressure is that a fraction of the monomers in the cartridges evaporates after the actual sterilisation, when the residual ethylene oxide is removed by the action of a vacuum, whereby the monomers form a gas phase in the cartridges and can thus exert a pressure against the plungers. This means that the plungers are moved in the direction of the cartridge floors in undesired manner and may be expelled from the cartridges in the extreme case such that the pastes may leak out.

Polymethylmethacrylate bone cements have been in use in medicine for decades for permanent mechanical fixation of total joint endoprostheses. They are based on powder-liquid systems. Recently, polymethylmethacrylate bone cements that are based on the use of cement pastes have been proposed also (DE 10 2007 050 762 A1, DE 10 2008 030 312 A1, DE 10 2007 052 116 A1). Thus far, no suitable cartridge systems have been proposed for said cements.

With regard to the application of bone cements for fixation of total joint endoprostheses, it is always necessary to take into consideration that the OR staff is under time pressure during these surgeries. Therefore, as a matter of principle, cartridge systems for medical applications involving the application of paste-like polymethylmethacrylate bone cements should be designed such that they are largely resistant to user errors and can be operated rapidly and safely even in stressful situations.

The methylmethacrylate monomer is an essential ingredient of paste-like polymethylmethacrylate bone cements. Said monomer evaporates readily and has a relatively high vapour pressure at room temperature. For this reason, it is essential to note with regard to the use of methylmethacrylate-containing pastes that the cartridge plungers in the cartridges may be moved and may be expelled from the cartridges in the extreme case by the evaporating methylmethacrylate upon exposure to vacuum, such as during the de-gassing as part of ethylene oxide sterilisation. A cartridge system of the kind is based on packaging pasty multi-component systems in tubular bags (WO 2010/006455 A1). In this context, the sealed tubular bags are inserted into cartridges. Tubular bags are advantageous in that they are suitable for packaging pastes that contain volatile ingredients. Tubular bags made of compound materials, such as aluminium compound bags, are particularly well-suited. The tubular bags are opened by blades that rotate along when the dispensing tube is screwed in. During the rotational motion of the blades, the bags are cut open, and openings in the cartridges for dispensing the content are thus provided. The pasty bag content is subsequently squeezed through these openings in the cartridges in the direction of the static mixer.

In this context, it is disadvantageous that packaging pasty materials in tubular bags and, in additional, in cartridges is quite expensive and reserved for special applications only. Moreover, it is a problem in many applications, especially in the field of medicine, that parts of the cut tubular bags may become detached and thus may enter into the pasty components and thus contaminate the mixing ware.

SUMMARY OF THE INVENTION

It is therefore the object of the invention to provide a cartridge system that is easy and inexpensive to manufacture, but at the same time allows the cartridges to be opened safely and easily. Safe storage and safe closure of paste-like components in at least two cartridges prior to their use should be ensured. The cartridge system should be safe and rapid to open right with minimal effort right before application of the pastes in order to enable simple application during surgeries and thus reduce and/or overcome the shortcomings of existing cartridge systems and their closure systems. Accordingly, a closure system is to be developed that safely closes cartridges for multiple components and allows the individual cartridges to be opened rapidly and without difficulties. Moreover, operating errors of the user attaching the dispensing tube should also be prevented.

Said objects are met in that a closure that can be shifted in the mixing space is arranged in the mixing space in a manner such that it closes the openings of the cartridges in a starting position and in that the openings to the mixing space are opened, at least in part, in a final position of the shiftable closure, whereby the shiftable closure can be shifted from the starting position to the final position.

In this context, the invention may provide the mixing space to be a hollow body, in particular a hollow cylinder, having hollow body walls, whereby the openings in the cartridges extend through the hollow body wall into the mixing space.

Furthermore, the invention proposes the mixing space to be arranged between the cartridges, in particular in a manner such that regions of the cartridge walls and the hollow body wall are provided as a single part.

The invention also proposes the mixing space to be arranged parallel to the cartridges.

In this context, the interior of the mixing space can be provided to have a mobile rod arranged in it parallel to the feed plungers and fixedly connected to the feed plungers through at least a fin and/or a plate, whereby the rod comprises a snap-in locking means on the side facing the outlet opening and an opposite snap-in locking means is attached in the mixing space that acts in concert with the snap-in locking means of the rod in a manner such that a motion of the rod out of the mixing space and therefore a motion of the feed plungers out of the cartridges is significantly hampered, in particular is prevented.

Moreover, the invention can provide the cartridge walls and/or the mixing space walls to include at least one slit that starts at the cartridge floor and is arranged parallel to the cartridge axis, whereby the width of the slit or slits is sufficient to take up the fin or fins and the length of the slit or slits extends, in particular, to at least half of the length of the cartridge.

Moreover, the invention proposes to arrange the outlet opening in a cartridge system head and the cartridge system head to comprise a fastening means for fastening a dispensing tube, in particular on the inside of the cartridge system head, preferably a thread or multiple pegs.

In this context, a limit stop, preferably in the form of pegs or fins, can be arranged in the mixing space and limits the motion of the shiftable closure in the direction of the centre of the mixing space thus define the final position of the shiftable closure.

Moreover, the invention proposes to arrange the shiftable closure in the mixing space in a press-fit manner.

The shiftable closure can also be provided to be shiftable in the longitudinal direction of the mixing space.

The invention also proposes the feed plungers to close the cartridges in a sealing manner.

The invention can also provide sealing means, in particular sealing rings, to be arranged on the openings of the cartridges towards the mixing space. The sealing means are designed to improve the sealing effect of the shiftable closure with respect to the openings in the cartridges in case the sealing effect of the shiftable closure through the press-fit is insufficient.

In this context, the sealing means around the openings to the mixing space between the internal wall of the mixing space and the shiftable closure can be provided to be arranged in the starting position.

Advantageous developments of the cartridge system can be characterised in that the shiftable closure comprises an extension in the form of a hollow body, in which openings are provided in the hollow body walls touching against the side walls of the mixing space.

The invention can also provide the shiftable closure to be a compact body or a hollow body, in particular a hollow cylinder, with one closed side.

Alternatively, the invention can provide the shiftable closure to be a hollow body that is open on both sides, and a dispensing tube to be arranged such as to be shiftable on the inside of the mixing space, whereby the dispensing tube comprises an open dispensing tube tip that faces the outlet opening or projects from it and an extension facing the cartridge floor, which extension is completely closed in the direction of the cartridge floor, and the extension to comprise openings in the side walls facing the cartridge walls, whereby a continuous connection extends on the inside of the dispensing tube from the openings to the dispensing tube tip and preferably has a static mixer arranged in it, whereby the external diameter of the extension is smaller than or equal to the internal diameter of the mixing space and larger than the internal diameter of the closure, whereas the remainder of the dispensing tube that is situated inside the mixing space has an external diameter that is smaller than the internal diameter of the closure.

In this context, the invention can provide a limit stop in the cartridge system head, in particular at the outlet opening, and can provide the feed plungers and/or the dispensing tube can be subjected to the application of compressed air.

The invention also provides a plate and/or at least one fin to be fixedly connected to the feed plungers on the floor side, and a locking means to be connected to the plate and/or at least one fin, whereby the locking means extends into the mixing space and therein engages a counter-locking means such that a motion of the plate and/or at least one fin and feed plungers in the direction of the cartridge floor is blocked, and an unlocking facility is provided on the inside of the mixing space that is fixedly connected to the shiftable closure such that shifting the shiftable closure into its final position is accompanied by an unlocking of the locking means such that a motion of the plate and/or at least one fin and feed plungers in the direction of the cartridge floor is made feasible.

The invention also relates to a dispensing tube for a cartridge system of this type, whereby the dispensing tube comprises, opposite from a dispensing tube tip of the dispensing tube, an extension whose diameter is smaller than the internal diameter of the mixing space, and which is designed to shift the shiftable closure during the insertion of the dispensing tube into the cartridge system head of the cartridge system such that the openings of the cartridges are open, at least in part.

In this context, the invention can provide the extension to be a hollow body, in particular a hollow cylinder, having openings, whereby, in the operational position of the dispensing tube in the cartridge system, openings in the extension are situated over the openings of the cartridges, at least in part, such that the internal spaces of the cartridges are connected to the mixing space through the openings.

The invention can also provide the dispensing tube to comprise a fastening means, preferably peg or a thread, in particular an external thread.

Moreover, the invention can provide the dispensing tube to comprise a static mixer.

And lastly, the invention proposes the dispensing tube to be fixedly connected to the shiftable closure such that the two together form a joint part of the cartridge system.

Said cartridge system and the corresponding closure system of the cartridge system are based on the surprising finding that the cartridge system can be opened reliably and with easy handling by means of a mobile closure without any need to destroy a component, such as the cartridge wall, while opening the cartridge such that no contamination of the components to be mixed or of the mixing wares by component materials needs to be feared. This allows for safe closure of the multi-component cartridges and rapid, uncomplicated, simultaneous opening of the individual cartridges of the system. Attaching the dispensing tube effects a forced, synchronous opening of the cartridges such that the cartridges are open only when the dispensing tube is attached, which prevents potential operating errors of the user.

A cartridge system of this type and a closure system of this type can be made altogether of inexpensive injection moulding parts. The cartridge system enables the plungers to be moved synchronously in the cartridges in the direction of the cartridge system head upon application of a force, and thus allows the pastes to be squeezed out evenly in order to ensure the proper mixing ratio of the pastes with respect to each other.

Further simplification and assurance of the operability of a cartridge system of this type is provided through the fact that a motion of the feed plungers upon the action of a vacuum can be safely prevented.

In the scope of the invention, the mixing space is understood to be the space situated between the at least two cartridges as well as the adjoining regions. It extends from the cartridge floor, i.e. the rear, floor-side part of the cartridge system, to the outlet opening on the cartridge system head on the front side of the cartridge system, and thus also comprises the internal space of the cartridge system head. In this context, the mixing of the starting components does not have to proceed in every space of the mixing space, but may proceed in sub-regions thereof. A mixing space that is connected to the cartridges through hoses, such that the mixing space is not situated exactly between the cartridges in a geometrical sense, is also included in the scope of the invention.

A shiftable closure in the scope of the invention is also understood to be a closure which is initially, in the starting position, connected through a fixed connection to the walls of the intermediate space, for example through thin bridges, provided said fixed connection includes predetermined breakage sites, which break when a force acts on the closure and thus facilitate shifting the closure under the action of a force.

In this context, the invention proposes the fixed connection or the fixed connections having the predetermined breakage sites to be provided in the direction, viewed from the openings of the cartridges, in which the closure moves during the opening process in order to prevent particles of the predetermined breakage sites from entering into the mixing wares and/or into the starting components of the mixing wares.

The final position in the scope of the invention is not to be understood as a conclusive final position. Accordingly, it would be conceivable, for example, that the shiftable closure can also be moved from the final position into the starting position then rendering the cartridges of the cartridge system ready for re-filling. This renders the cartridge system reusable. Moreover, the starting position, like the final position, is understood to be just one of at least two positions into which the shiftable closure can be shifted.

BRIEF DESCRIPTION OF THE DRAWINGS

In the following, exemplary embodiments of the invention are illustrated through sixteen schematic drawings. In the figures.

DETAILED DESCRIPTION

Figure 1:
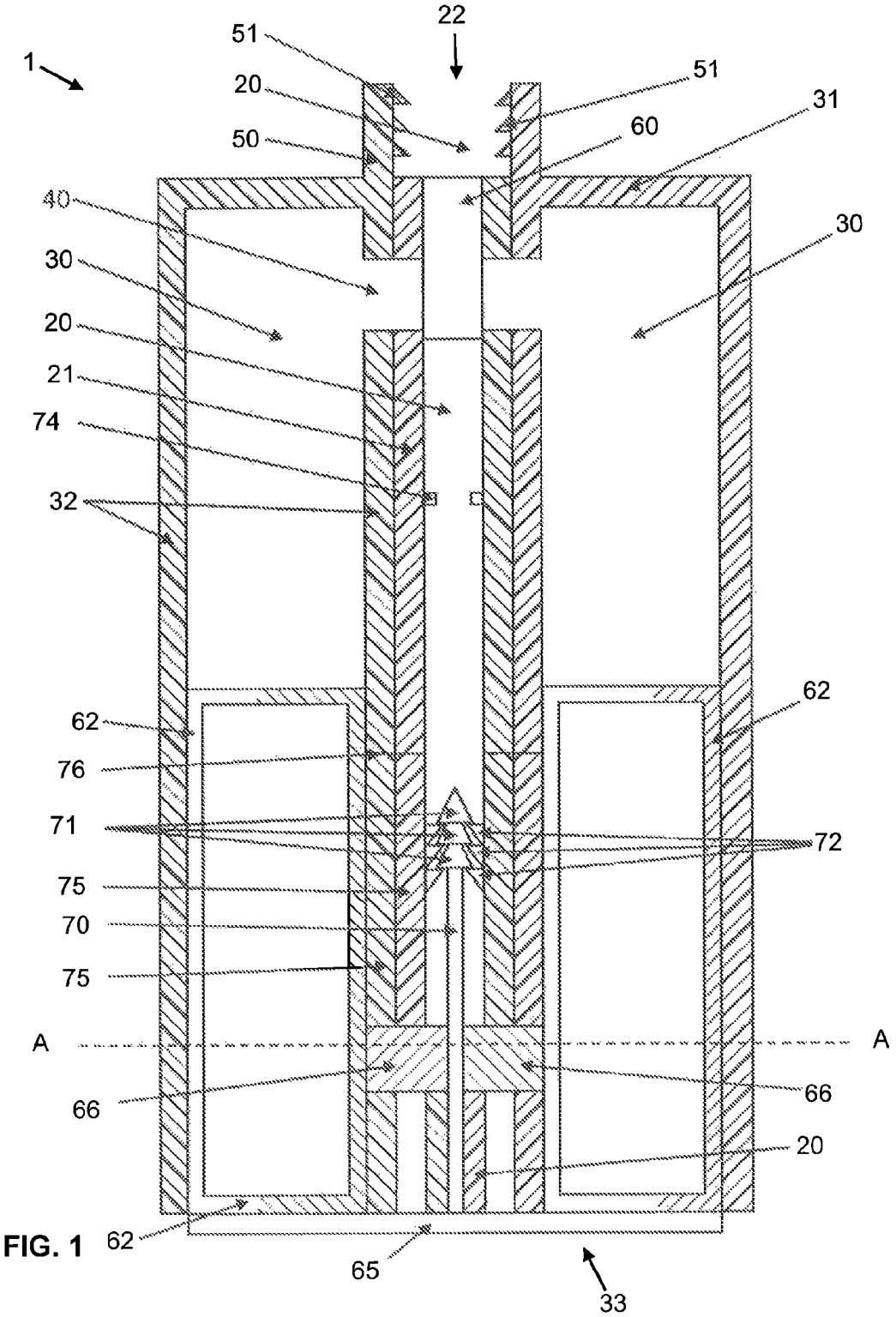
FIG. 1 shows a cross-sectional view in longitudinal direction of a cartridge system according to the invention.

FIG. 1 shows a cross-sectional view of a cartridge system (1) according to the invention having a mixing space (20) that is bounded by mixing space walls (21) and ends into an outlet opening (22). The mixing space (20) extends in the space between two cartridges (30) and is provided as a cylindrical hollow body. The cartridges (30) are bounded by cartridge heads (31), cartridge walls (32), and a cartridge floor (33). The starting components (not shown) for a mixing ware to be mixed are situated inside the cartridges (30). Openings (40) are situated in the cartridge walls (32) and mixing space walls (21) and connect the inside of the cartridges (30) to the inside of the mixing space (20). Accordingly, said cartridge system (1) is suitable for mixing a mixing ware consisting of two components.

The outlet opening (22) is formed in a cartridge system head (50) that comprises, on the inside, a fastening means (51) in the form of a thread or in the form of pegs which may also form a thread.

A shiftable closure (60) in the form of a massive cylinder is placed in press-fit manner in the upper end of the mixing space (20), i.e. the end facing the outlet opening (22). The shiftable closure (60) closes the openings (40) that connect the inside of the cartridges (30) to the inside of the mixing space (20). However, the shiftable closure (60) can just as well have a closed jacket surface.

Towards the cartridge floors (33), the cartridges (30) are closed through feed plungers (62). The feed plungers (62) can be shifted along the longitudinal direction of the cartridges (30) and can be equipped with common stripping lips and gaskets in order to ensure sealed closure of the cartridges (30).

The feed plungers (62) are connected to each other on the cartridge floor (33) through a fin (65) or a plate (not shown). An additional fin (66) that extends through the mixing space walls (21) and through the cartridge walls (32) can be provided on the inside of the cartridge system (1).

In addition, a rod (70) is fixedly connected through the fins (65, 66) and projects into the end of the mixing space (20) facing the cartridge floors (33). Snap-in locking means (71) are provided on the tip of the rod (70). Opposite snap-in locking means (72) engaging the snap-in locking means (71) are attached to the internal walls (21) of the mixing space (20). The opposite snap-in locking means (72) are made of a flexible material, for example rubber. The snap-in locking means (71) can be made of a common plastic material. When the rod (70) is slid into the mixing space (20) deeply enough for the snap-in locking means (71) to engage the opposite snap-in locking means (72), any motion of the rod (70) out of the mixing space (20) is prevented. At the same time, it is feasible without any difficulty to slide the rod (70) deeper into the mixing space (20).

Accordingly, what is situated in the mixing space (20) is the rod (70) that is arranged in longitudinal direction of the feed plungers (62) in a manner such that one end of it is fastened to the fins (65) and that it has a length equal at least to the length of the feed plungers (62). What is essential is that the rod (70) is cogged on the side facing the cartridge head (31). The cogs are oriented such that the tips of the cogs point in the direction of the cartridge floor (33). The rod (70) has a cross-section that is smaller than the cross-section of the mixing space (20).

A flexible snap-in device (72), whose cross-section is smaller than or equal to that of the cogged rod (70), is arranged on the end of the mixing space (20) on the side facing the cartridge floor (33). This means that the cogged rod can snap-in into said snap-in device (72). The snap-in device (72) is arranged in a manner such that the cogged rod (70) can only move in the direction of the cartridge head (31). A retrograde motion towards the cartridge floor (33) is not feasible.

The position of the feed plungers (62) in the cartridges (30) is fixed through the cogged rod (70) and the snap-in device (72) such that a retrograde motion of the feed plungers (62) out of the cartridges (30) is safely prevented even upon the action of a vacuum.

The shiftable closure (60) can be shifted through the outlet opening (22) towards the cartridge floor (33) by the action of a force. The force can be made to act by inserting a suitable dispensing tube (not shown) into the outlet opening (22). A limit stop (74) attached in the form of pegs on the internal walls (21) of the mixing space (20), prevents the shiftable closure (60) from being slid beyond the limit stop (74) into the mixing space (20). In this manner, the limit stop (74) defines the final position of the shiftable closure (60).

In order to allow the fins (65, 66) to move through the mixing space walls (21) and the cartridge walls (32) facing the mixing space (20), these are provided with a slit (75) that extends from the cartridge floors to the slit end (76) on the inside of the cartridge system (1). The fins (65, 66) can move through said slit (75) without any difficulty.

Figure 2:
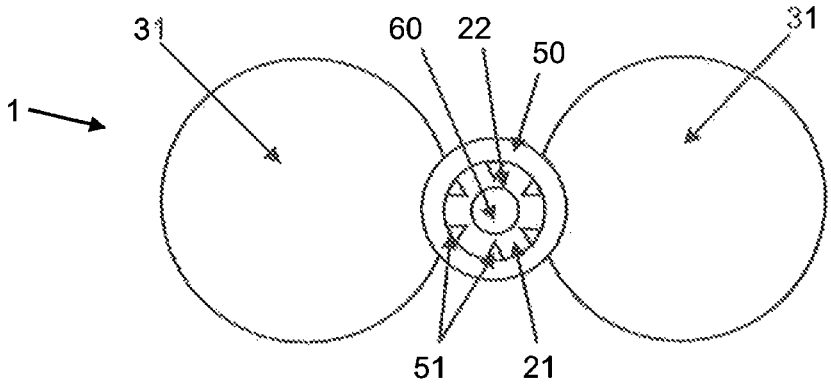
FIG. 2 shows a top view onto the front side of a cartridge system according to the invention having the outlet opening according to FIG. 1.

FIG. 2 shows a top view onto a cartridge system (1) of this type, more particularly onto the cartridge system head (50). A glance into the outlet opening (22) shows the mixing space walls (21), the fastening means (51), and the shiftable closure in the middle (60). The cartridge heads (31) of the cartridges (30) situated underneath (not shown in FIG. 2) are provided on both sides of the cartridge system head (50).

Figure 3:
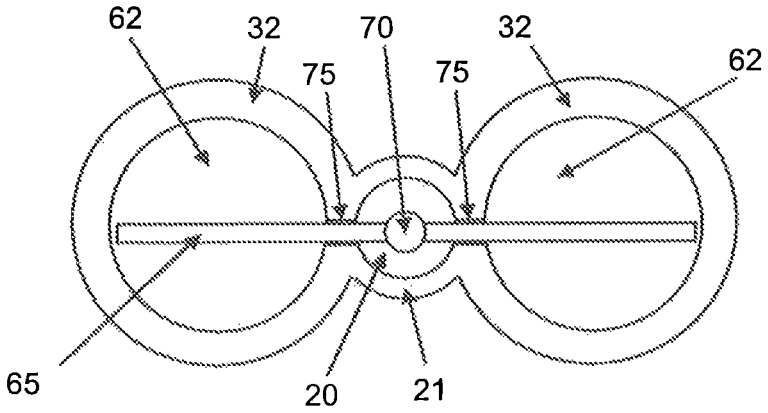
FIG. 3 shows a top view onto the cartridge floor of a cartridge system according to the invention according to FIG. 1.

FIG. 3 shows a top view onto a cartridge system (1) of this type from the direction of the cartridge floor (33). Bounded by the mixing space walls (21), the mixing space (20) is flanked on both sides by the cartridges (30) of which only the cartridge walls (32) and the feed plungers (62) are shown. The rod (70) that projects into the inside of the mixing space (20) is situated in the middle of said mixing space (20) that is open in this direction. The rod (70) and the feed plungers (62) are fixedly connected to each other through the fin (65). In order to allow for motion of the fin (65) into the inside of the cartridge system (1), a slit (75) is provided in the walls (21, 32) of the mixing space (20) and cartridges (30).

Figure 4:
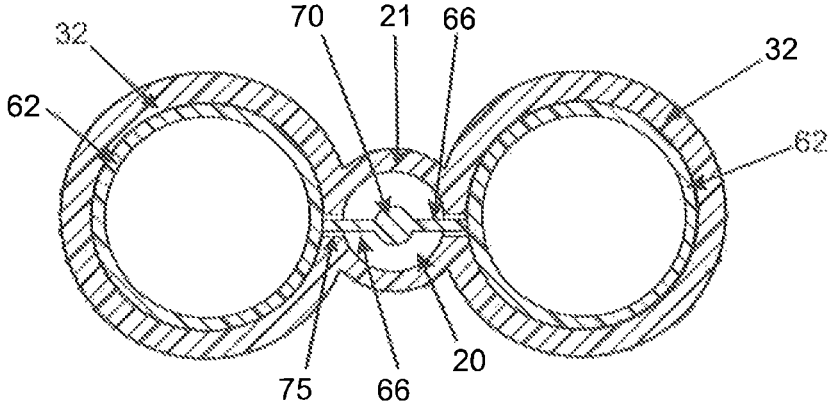
FIG. 4 shows a cross-sectional view of a cartridge system according to FIG. 1 along the line AA in FIG. 1.

FIG. 4 shows a cross-sectional view of a cartridge system (1) of this type along the section, (AA), in FIG. 1. Bounded by the mixing space wall (21), the mixing space (20) is situated between the two cartridges (30) that can be seen through the feed plungers (62) and the cartridge walls (32). The feed plungers (62) are structured to be hollow cylinders that are closed on both sides. The inside of the mixing space (20) has the rod (70) arranged in it. The rod (70) and the feed plungers (62) are connected to each other through the fin (66). Slits (75) are provided in the walls (21, 32) connecting the cartridges (30) to the mixing space (20) and allow the fin (66) and the fin (65) to move inside the cartridge system (1).

Figure 5:
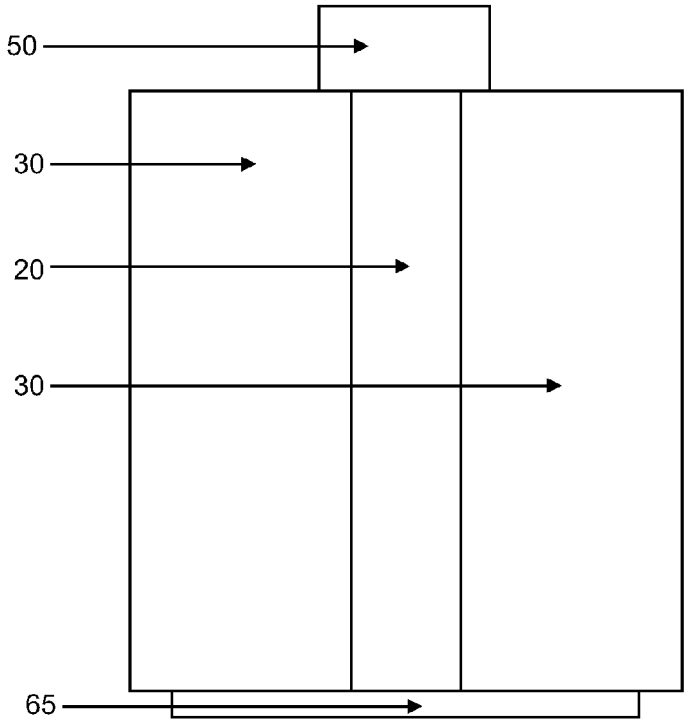
FIG. 5 shows a side view of a cartridge system according to the invention according to FIG. 1.

FIG. 5 shows a side view of a cartridge system. The mixing space (20) is arranged between the two cartridges (30). Actually, only the mixing space walls (21) and/or the cartridge walls (32) would be recognisable from outside. The cartridge system head (50) is arranged on the head side of the cartridge system (1), whereas the fin (65) is arranged on the cartridge floor (33).

Figure 6:
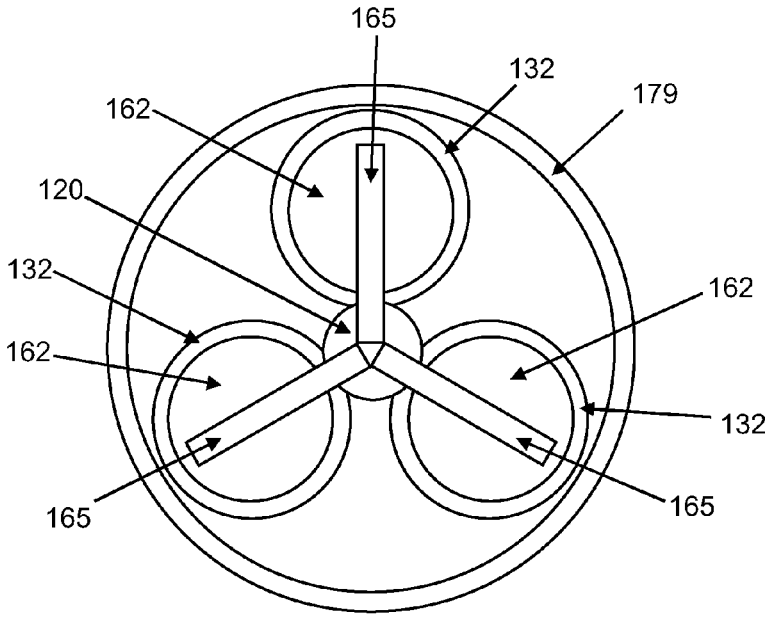
FIG. 6 shows a top view onto a cartridge floor of a second cartridge system according to the invention.

FIG. 6 shows a top view onto a cartridge floor of an alternative cartridge system for mixing a mixing ware consisting of three components. For this purpose, the cartridge system comprises three cartridges of which only the cartridge walls (132) and the feed plungers (162) can be seen from the direction of the cartridge floor. The mixing space (120) is situated between the cartridge walls (132) and has a rod (not shown) situated in its middle. The rod and the feed plungers (162) are fixedly connected to each other through fins (165). The entire cartridge system is enclosed through an additional jacketing (179).

All embodiments described can be applied without any difficulty to a cartridge system with three, four or even more cartridges for the mixing of a mixing ware made of three, four or even more components. With regard to the use with very many components, it is expedient not to provide the cartridges to be cylindrical in shape.

Figure 7:
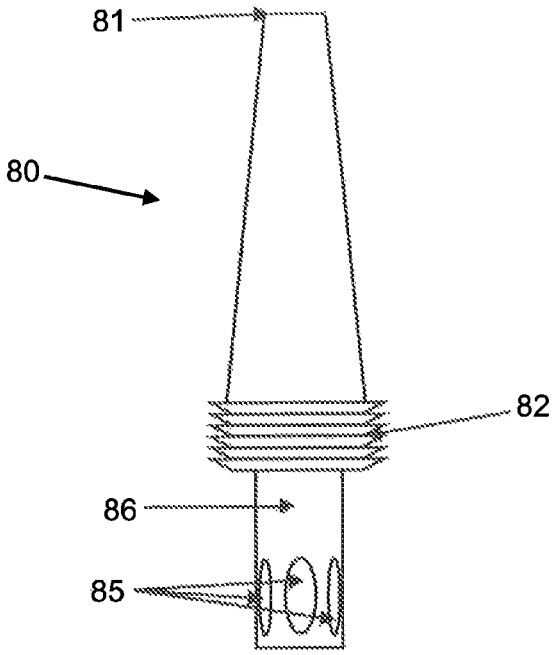
FIG. 7 shows a dispensing tube for a cartridge system according to the invention.

FIG. 7 shows a side view of a dispensing tube (80) for a cartridge system (1) according to the invention. The dispending tube tip (81) that serves for application of a mixed mixing ware is situated on the top end of the dispensing tube (80). Situated underneath, there is an external thread (82) that can be used to screw the dispensing tube (80) into the internal thread (51) of the cartridge system (1). Openings (85) are provided in an extension (86) that is situated underneath.

The external diameter of the extension (86) is the same as or smaller than the diameter of the mixing space (20). By this means, when the dispensing tube (80) is being screwed into the cartridge system head (50), the extension (86) can penetrate into the mixing space (20) beyond the cartridge system head (50) and thus slide the shiftable closure (60) deeper into the mixing space (20). This opens the openings (40) to the mixing space (20). The extension (86) is provided as hollow cylinder and the openings (85) serve to not block the starting components to be mixed, which pass through the openings (40) in the cartridge walls (32). Accordingly, the materials to be mixed pass through both openings (40) and openings (85).

Figure 8:
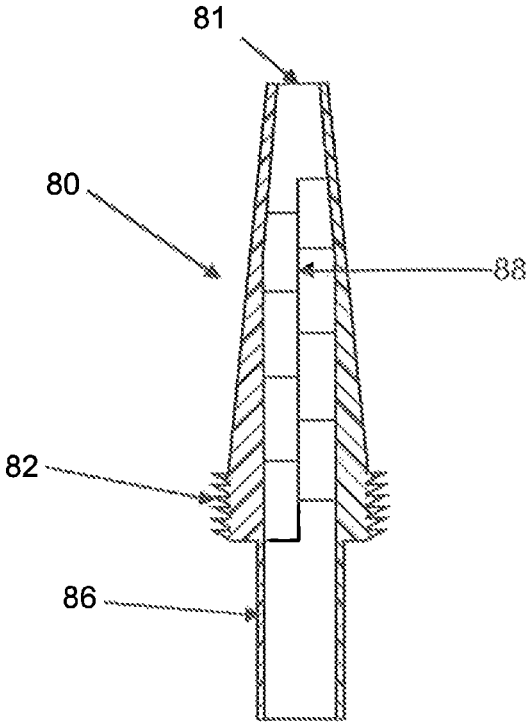
FIG. 8 shows a cross-sectional view in longitudinal direction of a dispensing tube according to the invention according to FIG. 7.

FIG. 8 shows a cross-sectional view of a dispensing tube (80) of this type according to FIG. 7. In addition to the dispending tube tip (81), the external thread (82), and the extension (86) in the form of a hollow cylinder, a static mixer (88) is also provided inside the dispensing tube (80).

However, an extension (86) might also be formed by a rod that ends in a tee piece, which is provided, for example, as an extension of the central axis of the static mixer (88). An extension (86) of this type would not need to have additional openings (85). Just as well, an extension of the static mixer (88) beyond the thread (82) might serve as extension (86).

Figure 9:
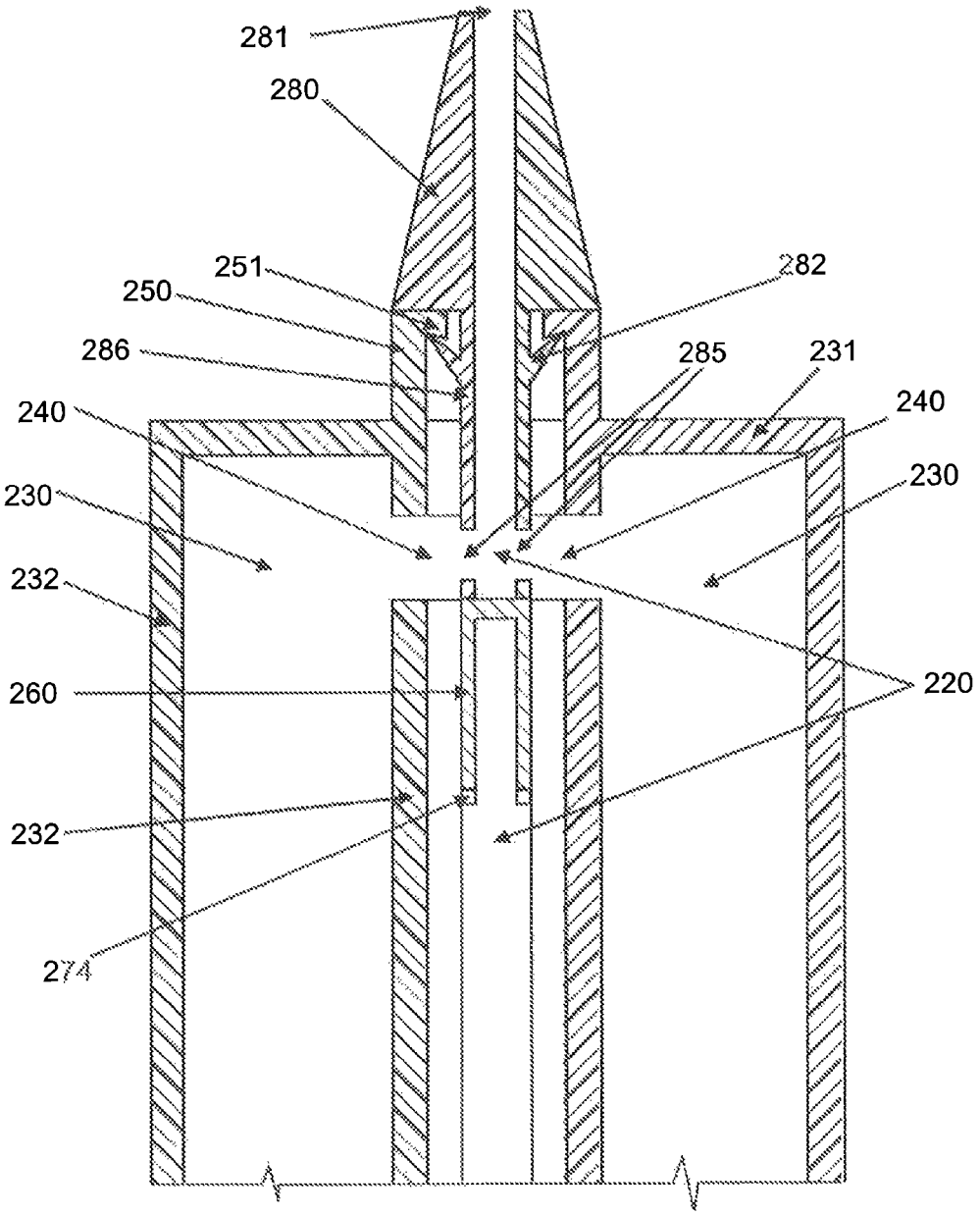
FIG. 9 shows a cross-sectional view of the front part of a third cartridge system according to the invention with the dispensing tube inserted.

FIG. 9 shows the upper (cartridge head side) part of a second cartridge system according to the invention having an incorporated dispensing tube (280). The dispensing tube (280) is fully incorporated into the cartridge system head (250) which is evident from the fastening means (251) of the cartridge system head (250), which is provided through pegs in this case, engaging the fastening means (282) of the dispensing tube (280). In said assembled state, the extension (286), which is provided as hollow body having openings (285), extends so deeply into the mixing space (220) that the shiftable closure (260) is shifted along the mixing space (220) away from its starting position and more deeply into the inside of the cartridge system.

In this case, the shiftable closure (260) is structured to be a hollow cylinder with one closed side. To prevent the mixing ware and the starting components from entering the cartridge floor-side part of the mixing space (220), the shiftable closure (260) is closed on the side that faces the dispensing tube (280). It is feasible just as well to design the end of the extension (286) such that is closes the entire cross-section of the mixing space (220).

The final position of the shiftable closure (260) is defined by a limit stop (274) in the form of a ring on the inside of the mixing space (220). The cartridges (230) are bounded by the cartridge walls (232) and the cartridge heads (231) as well as feed plungers (not shown in FIG. 9).

If pressure is applied to the feed plungers (not shown) while the dispensing tube (280) is inserted, starting components for the mixing ware stored in the cartridges (230) are squeezed through the openings (240, 285) into the mixing space (220). In the mixing space (220), the starting components are mixed and thus the mixing ware is produced. The mixing of the mixing ware can be enhanced by a static mixer (not shown in FIG. 9) in the dispensing tube (280). Lastly, the mixed mixing ware exits from the cartridge system through the dispensing tube tip (281) and can be applied wherever needed.

Figure 10:
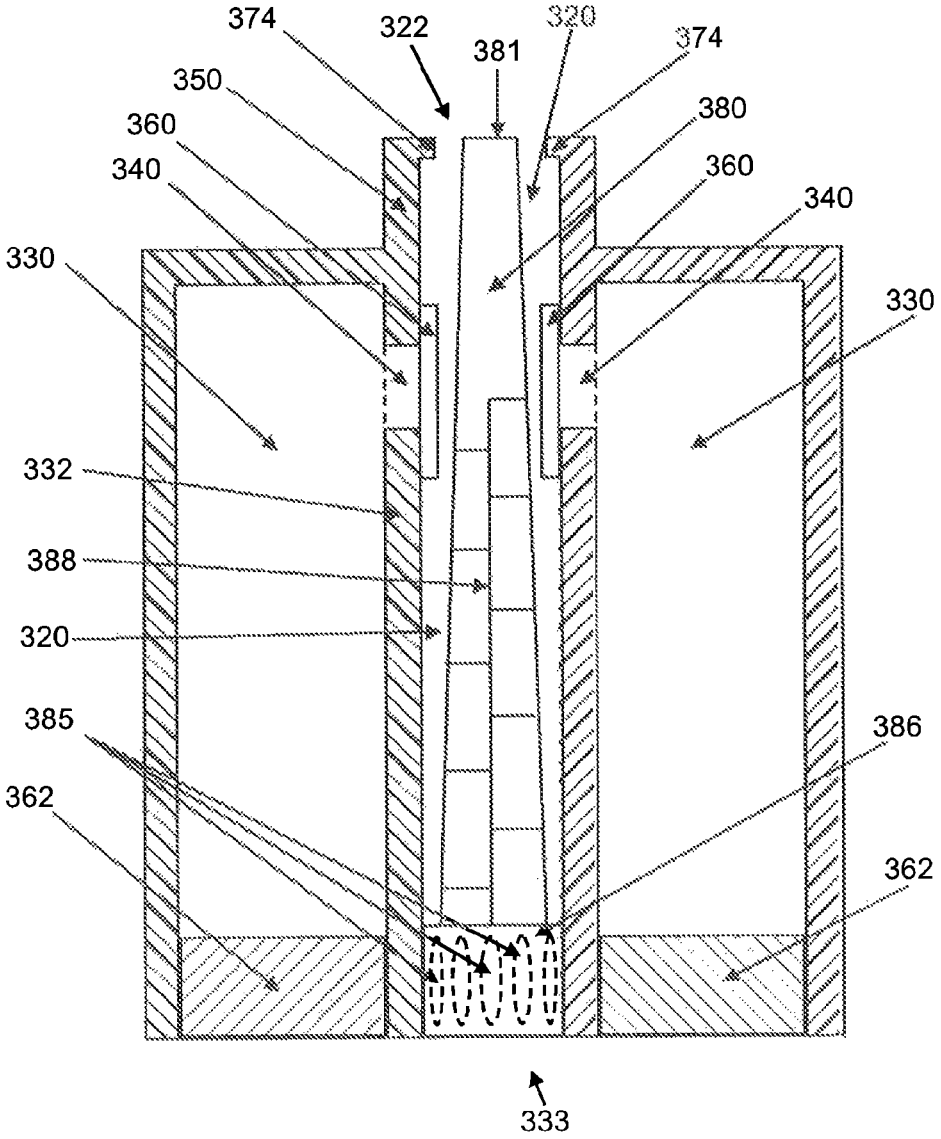
FIG. 10 shows a cross-sectional view of a cartridge system according to the invention with an integral dispensing tube.

FIG. 10 shows a cross-sectional view of a fourth exemplary embodiment of a cartridge system according to the invention. In this variant, the dispensing tube (380) is already integrated into the mixing space (320) of the cartridge system with the closure (360) in closed position. Accordingly, in order to use a cartridge system of this type, the dispensing tube (380) is not inserted into the outlet opening (322) and fastened therein, like in the preceding exemplary embodiments, but rather it is pressed from the direction of the cartridge floor (333) in the direction of the outlet opening (322).

For this purpose, the closure (360) is a hollow cylinder which, in its starting position, closes, in press-fit, the openings (340) in the cartridge walls (332) and therefore of the cartridges (330) with respect to the mixing space (320). The internal diameter of the closure (360) is larger than the external diameter of the front part of the dispensing tube (380) that faces the dispensing tube tip (381). The extension (386) is provided with openings (385) and has an external diameter that is larger than the internal diameter of the closure (360). In addition, a step is provided between the extension (386) and the front part of the dispensing tube (380). The extension (386) is a hollow cylinder having openings (385) that is open in the direction of the dispensing tube tip (381) and completely closed in the direction of the cartridge floor (333). A static mixer (388) is situated inside the dispensing tube (380).

Application of a force to the mixing space (320) of said cartridge system from the direction of the cartridge floor (333), for example through compressed air, slides the dispensing tube (380) in the direction of the cartridge system head (350). As soon as the front edge of the extension (386) facing the dispensing tube tip (381) meets the cartridge floor-side end of the closure (360), the dispensing tube (380) also shifts the closure (360) into the cartridge system head (350). The motion of the closure (360) is limited by a limit stop (374) that is arranged on the tip of the cartridge system head (350). In its final position, the closure (360) frees the openings (340) completely and touches against the limit stop (374). At the same time, the openings (385) of the extension (386) are situated over the openings (340).

If a force is then exerted, for example by applying compressed air, from the direction of the cartridge floor (333) to two feed plungers (362), the content of the cartridges (330) is squeezed through the openings (340) and the openings (385) into the extension (386) of the dispensing tube (380). The static mixer (388) is used to mix the contents of the cartridges (330) in the dispensing tube (380) to form a mixing ware. Lastly, the mixed mixing ware is squeezed through the dispensing tube tip (381) out of the cartridge system.

Unlike the preceding exemplary embodiments, this exemplary embodiment has the closure (360) being slid not in the direction of the cartridge floor (333), but rather in the direction of the cartridge system head (350) in order to free the openings (340). The feed plungers (362) can be connected to each other through a fin (not shown) such that the motion of the feed plungers (362) is synchronised.

Therefore, according to the invention, a shiftable dispensing tube (380) that can be shifted in the longitudinal direction of the cartridges (330) and contains a static mixer (388) is situated in the mixing space (320), and the external diameter of the dispensing tube (380) on its side facing away from the cartridge system head (350) is smaller than the internal diameter of the closure (360) in the form of an open hollow cylinder, a hollow cylinder that has a perforated jacket surface and is closed in a gas-tight manner on its side facing away from the cartridge system head (350) and whose external diameter is equal to the internal diameter of the mixing space (320) is arranged as extension (386) on its side facing away from the cartridge system head (350), and pegs and/or fins are situated as limit stop (374) in the mixing space (320) above the openings (340) of the cartridges (330) whose internal diameter is larger than or equal to the internal diameter of the shiftable closure (360). This means that the dispensing tube (380) can be moved from the direction of the cartridge floor (333) in the direction of the cartridge system head (350) by application of compressed gas. During this motion of the dispensing tube (380), the shiftable closure (360), which is provided as a hollow cylinder, is moved in the direction of the cartridge system head (350) until it stops against fins or pegs (374) on the cartridge system head (350). The openings (340) of the cartridges (330) are freed through said motion of the hollow cylinder (360) in the direction of the cartridge system head (350). Simultaneously, the perforations (385) of the hollow, perforated cylinder (386) move over the openings (340) of the cartridges (330). This opens the cartridges (330). Alternatively, the motion of the dispensing tube (380) can proceed through action of a mechanical force through the motion of rods, screws or studs.

Figure 11:
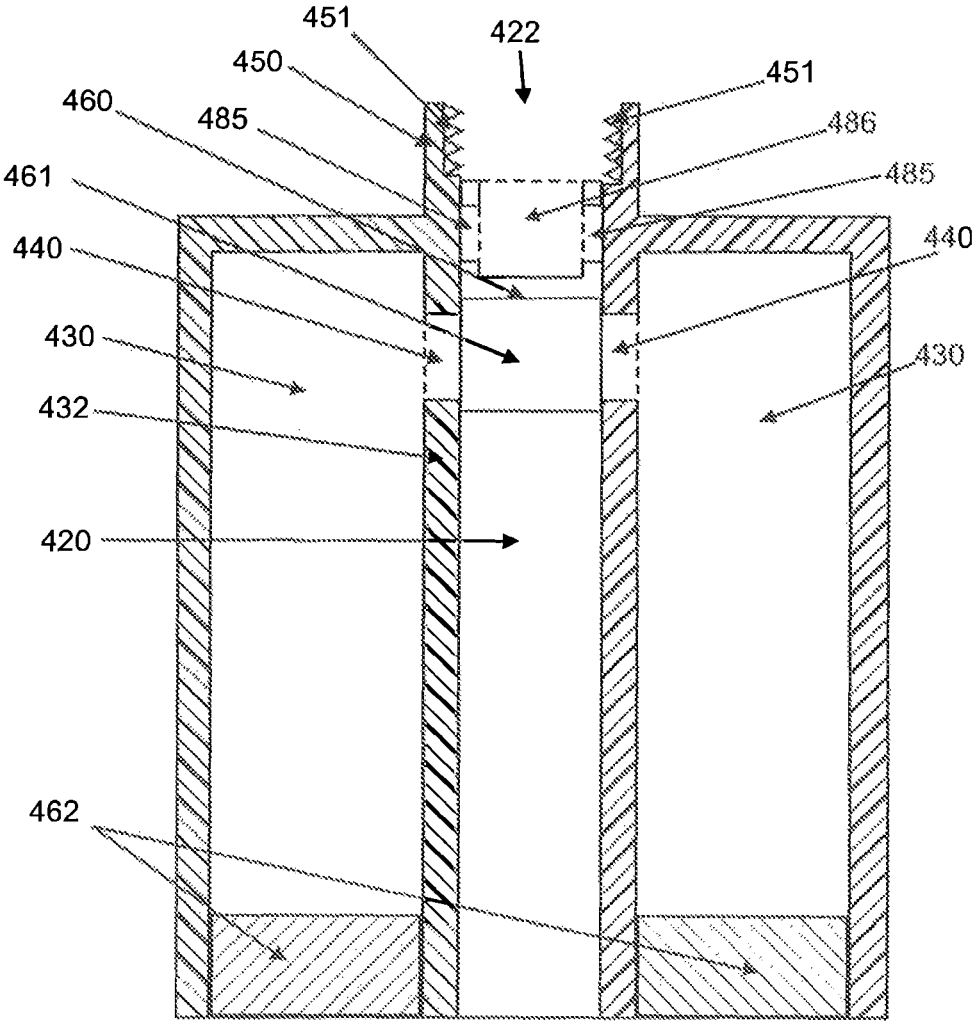
FIG. 11 shows a cross-sectional view of a fifth cartridge system according to the invention.

A schematic cross-sectional view of a fifth alternative example of a cartridge system according to the invention is shown in FIG. 11. A mixing space (420) is arranged between two or more cartridges (430). Openings (440) connecting the internal spaces of the cartridges (430) and the mixing space (420) to each other are provided in the cartridge walls (432) that separate the cartridges (430) from the mixing space (420). The cartridges (430) are closed in a sealing manner on the lower end by feed plungers (462). A closure (460) that is arranged in a press-fit manner in the mixing space (420) and completely closes the cross-section of the mixing space (420) also closes the openings (440) completely. At the same time, it [the closure] is arranged in the mixing space (420) such that it can be shifted in longitudinal direction. The cartridge system comprises a cartridge system head (450), in which an internal thread (451) for attachment of a dispensing tube is provided.

The closure (460) consists of two parts. A closure part (461) serves to completely close the openings (440) in the starting position of the closure (460). The closure (460) comprises, as the second part, an extension (486) which is provided on the dispensing tube rather than the closure in all preceding exemplary embodiments. The extension (486) is provided as a hollow body that is closed on one side and includes openings (485) in the side walls.

Upon a dispensing tube being fastened in the outlet opening (422) through screwing it into the thread (451), the closure (460) in the mixing space (420) is slid away from the outlet opening (422). If the dispensing tube comprises, below its external thread, an extension that is approximately equal to the length of the extension (486) of the closure (460), the closure is slid into the mixing space (420) exactly to the extent that the openings (485) of the extension (486) are situated over the openings (440) in the cartridge walls (432) in the final position of the closure (460). This is the case because the front edge of the closure (460) facing the outlet opening (422) is arranged on the lower end of the internal thread (451) of the cartridge system head (450) in the starting position.

Figure 12:
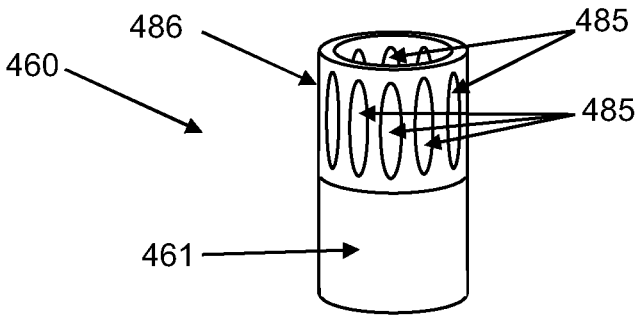
FIG. 12 shows a perspective view of a shiftable closure for a cartridge system according to FIG. 11.

A closure (460) of this type is shown in a perspective view in FIG. 12. The closure (460) shown has cylindrical geometry and is also suitable for a mixing space (420) having a cylindrical internal space. The closure (460) consists of two parts, namely the closure part (461) and the extension (486). The extension (486) includes multiple oval openings (485) that extend through the cylinder wall of the extension (486).

Figure 13:
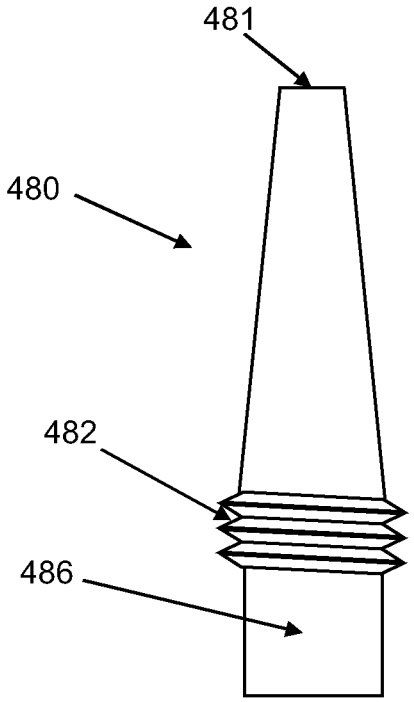
FIG. 13 shows a side view of a dispensing tube for a cartridge system according to FIG. 11.

FIG. 13 shows a dispensing tube (480) for a cartridge system of this type as shown in FIG. 11. The dispensing tube (480) comprises a dispensing tube tip (481), an external thread (482), and an extension (486). The extension (486), which establishes contact between the closure part (461) and the dispensing tube (480) when the dispensing tube (480) is incorporated in the cartridge system, thus is subdivided in this exemplary embodiment into a part having openings (485) on the closure (460) and a part on the dispensing tube (480). Accordingly, in the scope of the invention, the extension (486) can be both part of the closure (460) and also part of the dispensing tube (480).

Obviously, it is feasible just as well to structure the extension to be a part just of the closure; for this purpose, the extension (486) of the closure (460) would have to extend into or through the outlet opening (422) or at least to the region of the internal thread (451) in the present case. Upon the dispensing tube (480) being screwed in, the lower edge of the external thread (482) would then meet an upper edge of the extension (486) of the closure (460) and thus transition the closure (460) into the desired final position.

Figure 14:
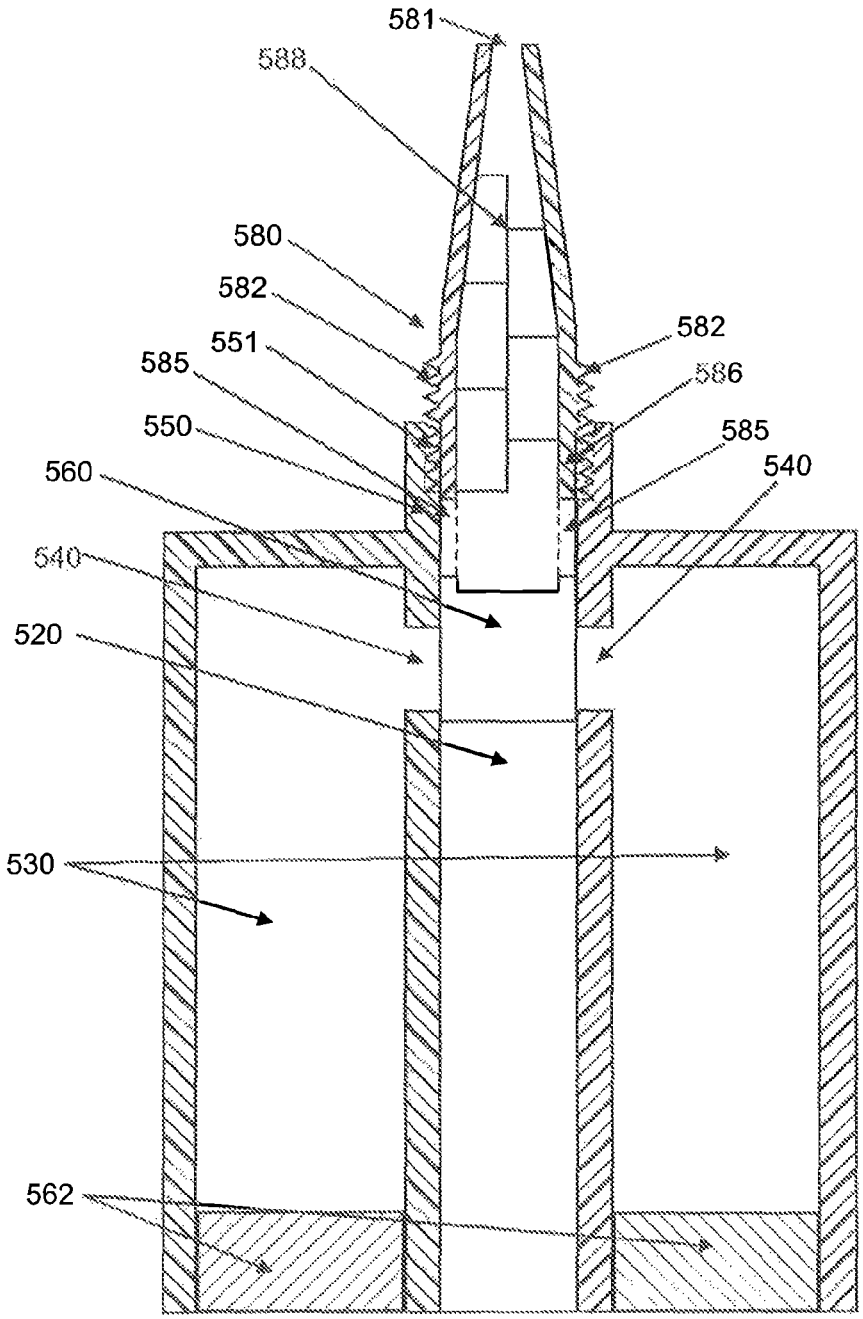
FIG. 14 shows a cross-sectional view of a sixth cartridge system according to the invention with an integral dispensing tube.

A schematic cross-sectional view of a sixth exemplary embodiment of a cartridge system according to the invention is shown in FIG. 14. In this exemplary embodiment, a closure (560) and the dispensing tube (580) form a unit. Both parts are fixedly connected to each other through an extension (586) in this case. The dispensing tube part (580) further comprises a dispensing tube tip (581), a fastening means (582), and a static mixer (588). Openings (585) are provided in the connection, i.e. in the extension (586).

In its starting position, the closure (560) is placed in a press-fit manner in a mixing space (520) that is situated between two cartridges (530) which are closed on their floor side through feed plungers (562). In said position, the closure (560) closes two openings (540) that connect the interior spaces of the cartridges (530) to the interior space of the mixing space (520). A cartridge system head (550) that extends the mixing space (520) comprises, on the inside, a fastening means (551) that can act in concert with the fastening means (582) of the dispensing tube (580). The fastening means (551, 582) can, for example, be internal and external threads. The two threads can already be partially engaged to each other in the starting position of the closure (560). Upon the system of closure (560) and dispensing tube (580) being screwed-in or fastened, the closure (560) is shifted such that the openings (540) are freed, whereby, in the final position, the openings (585) are situated over the openings (540).

Figure 15:
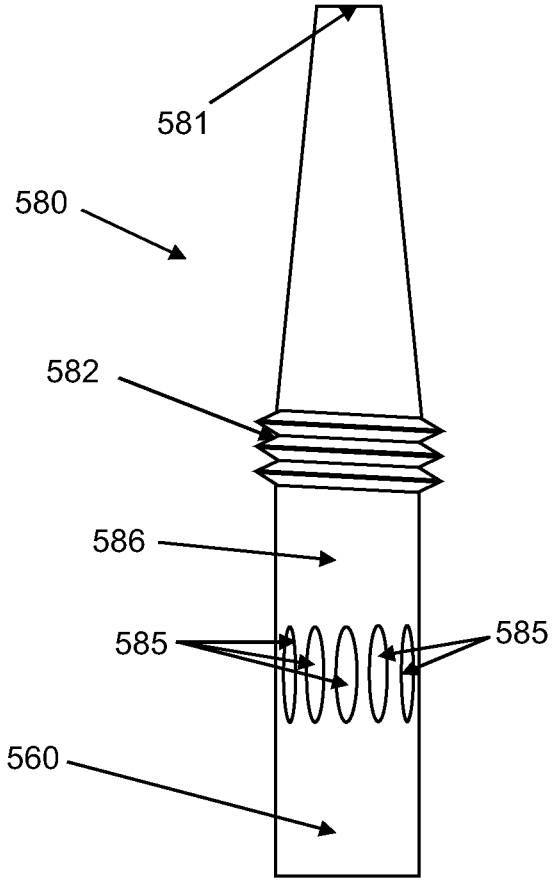
FIG. 15 shows a side view of a shiftable closure with integral dispensing tube for a cartridge system according to FIG. 14.

FIG. 15 shows a schematic side view of a system of this type of closure (560) and fixedly connected dispensing tube (580). An external thread (582) is provided as fastening means in the system shown. Instead of the left-hand thread shown, a right-hand thread can obviously be used just as well. As before, oval openings are provided as openings (585) through which the starting components of the mixing ware to be mixed can enter into the inside of the dispensing tube (580).

Through an external thread (582), the dispensing tube (580) is screwed into the internal thread (551); in the process, the extension (586), which is perforated at the cylinder jacket, is moved in the direction of the cartridge floor and, simultaneously, the hollow body (560), which acts as shiftable closure and has a closed jacket surface, is also moved in the direction of the cartridge floor until the perforations of the perforated extension (586) are situated over the openings (540) of the cartridges (530).

Figure 16:
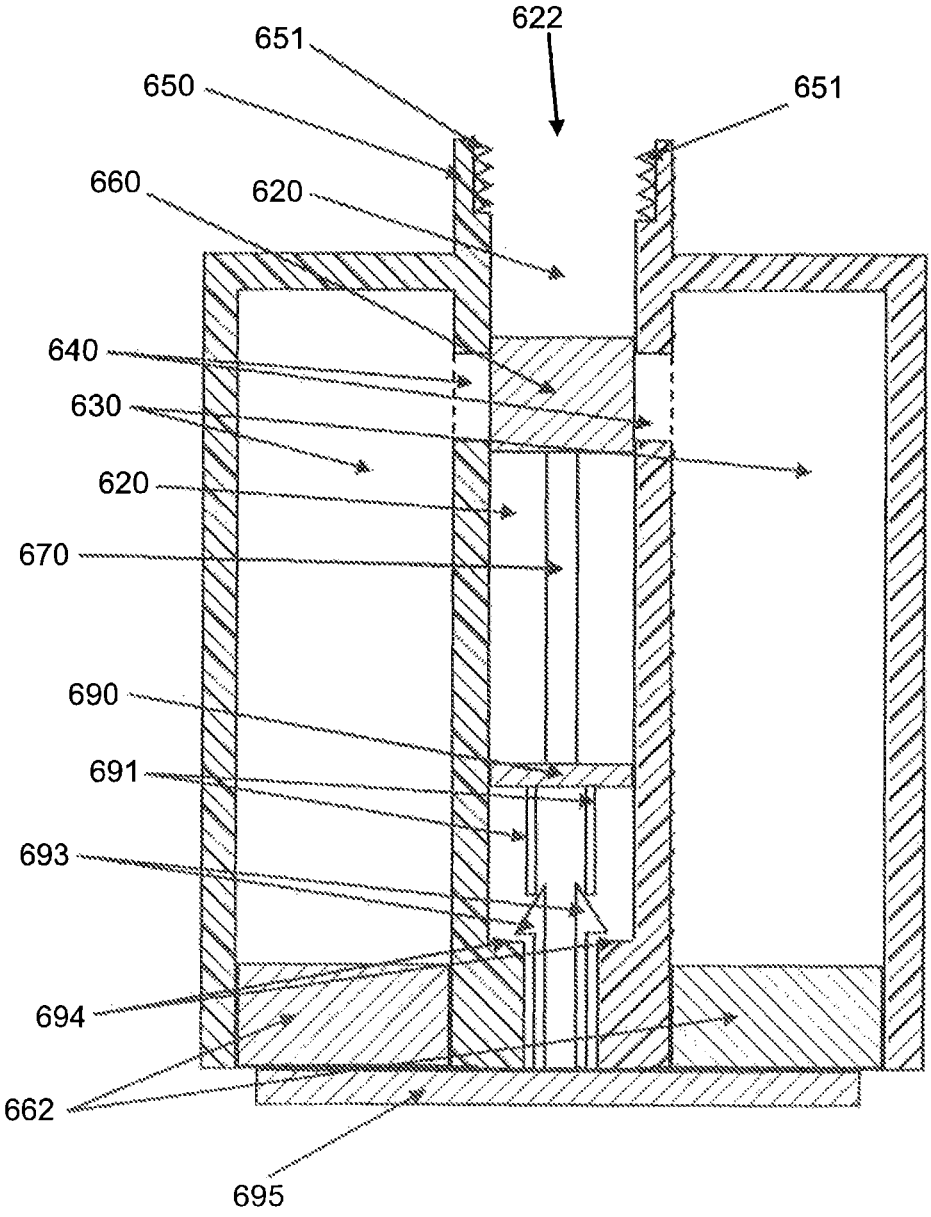
FIG. 16 shows a cross-sectional view of a seventh cartridge system according to the invention having an unlocking device attached to the closure.

FIG. 16 shows a schematic cross-sectional view of a seventh exemplary embodiment of a cartridge system according to the invention. This exemplary embodiment has a rod (670) arranged on a closure (660), which rod (670) projects from a centring facility (690) in the centre of a mixing space (620) that is provided as a hollow body. An unlocking facility (691) in the form of a hollow cylinder is provided on the rod (670) and/or the centring facility (690) thereof. The closure (660) closes openings (640) which connect cartridges (630) to the mixing space (620). A cartridge system head (650) having a fastening means (651) for fastening a dispensing tube is situated on the front end of the cartridge system. The cartridge system head (650) is structured to be a hollow cylinder that forms an outlet opening (622) on the inside.

On the floor side, the cartridges (630) are closed through feed plungers (662). The feed plungers (662) are connected to each other through a plate (695). Two locking hooks (693) are connected to the plate (695) in a manner such that the plate (695) can be slid over the locking hooks (693) in the direction of the outlet opening (622) over the locking hooks (693) without any difficulty, but cannot be slid over the locking hooks (693) in the opposite direction. For this purpose, the locking hooks (693) may be structured, for example, in a manner such that they are fixedly connected to each other and extend through a hole in the plate (695) whose diameter is larger than the width of the two locking hooks (693), and the locking hooks (693) are fixedly connected there to a second plate (not shown) whose diameter is larger than the diameter of the hole in the plate (695). However, the locking hooks (693) may just as well simply be removed after taking out the plate. It is also conceivable that the locking hooks (693) break off through the action of the unlocking facility (691) or are squeezed together irreversibly, at least in part, such that they cannot snap-in again afterwards. Other locking means (693) may be used instead of the locking hooks (693).

The locking hooks (693) are made of a flexible material such that they can be squeezed together relatively easily. A locking step (694) is arranged in the region of the locking hooks (693) in the mixing space (620) such that the hooks of the locking hooks (693) can engage the locking steps (694).

In its starting state, the closure (660) closes the openings (640). The locking hooks (693) prevent a motion of the plate (695) and thus of the feed plungers (662) connected to the plate (695) out of the cartridges (630).

If a dispensing tube having an extension is incorporated into the outlet opening (622), the openings (640) are freed and the unlocking facility (691) is slid over the locking hooks (693) in a manner such that these are squeezed together and thus a motion of the plate (695) away from the outlet opening (622) and thus [a motion] of the feed plungers (662) out of the cartridges (630) is made feasible.

Accordingly, the hollow cylinder (691) arranged on the centring facility (690) is slid over the locking hooks (693) simultaneous to the insertion of the dispensing tube, whereby the locking hooks (693) bend perpendicular to the longitudinal axis of the mixing space (620), and whereby the blocking pegs locking hooks (693) move away from the locking step (694) and thus the locking of the plate (695) is unlocked.

One variant of the invention is characterised in that an internal thread (651) or snap-in closure is arranged on the side of the mixing space (620) facing the cartridge system head (650), in that a shiftable closure (660), which can be shifted in longitudinal direction of the cartridges (630), is situated in press-fit manner in the mixing space (620) and is closed on the side facing the cartridge system head (650) over its surface perpendicular to the longitudinal axis of the hollow space (620), in that the shiftable closure (660) is arranged above the openings (640) of the cartridges (630), in that the shiftable closure (660) is connected through a rod (670) to a circular or star-shaped centring ring (690), on the underside of which a hollow cylinder (691) is arranged, in that the hollow cylinder (691) has a diameter that is smaller than the internal diameter of the mixing space (620), in that an external thread or a hollow cylinder having pegs is arranged on one end of the insertable dispensing tube, and in that an extension having a perforated cylinder jacket, which is provided in the form of a hollow cylinder or any other perforated hollow body that is open in longitudinal direction and has a perforated jacket surface, i.e. provided with openings, is arranged in longitudinal direction on the end of the external thread or of the cylinder having pegs, as is shown in FIGS. 7 and 8.

The advantage of this arrangement is that the cartridges (630) are opened and the dispensing tube is inserted simultaneously, and the cartridge floors that are closed by the plate (695) are released simultaneously as well. Through this means, the user can insert the starting component-filled cartridge inserts in the respective cartridge applicator gun/cement gun, which is used to operate the cartridge system, only once the dispensing tube is inserted and the plate (695) used to close the cartridge floors is unlocked and removed. Accordingly, it is impossible to insert cartridge inserts in cartridge applicator gun or cement guns for operation of the cartridge system unless the dispensing tube is inserted and unless the cartridges (630) are open. This renders faulty operation virtually impossible.

For example, according to the invention, the cartridge system made of at least two cartridges (30, 230, 330, 430, 530, 630) is structured in a manner such that a) two or more cartridges (30, 230, 330, 430, 530, 630) are arranged around an internal hollow cylinder or an internal irregularly- or regularly-shaped hollow body and have longitudinal axes that extend parallel to the axis of the internal hollow cylinder (20, 120, 220, 320, 420, 520, 620) or of the irregularly- or regularly-shaped hollow body (mixing space 20, 120, 220, 320, 420, 520, 620);

b) below the cartridge heads (31, 231), one or more openings (40, 240, 340, 440, 540, 640) are arranged in the cartridge walls (32, 132, 232, 332, 432);

c) said openings (40, 240, 340, 440, 540, 640) connect the internal spaces of the cartridges (30, 230, 330, 430, 530, 630) to the internal space of the internal hollow cylinder (20, 120, 220, 320, 420, 520, 620) or of the internal irregularly-shaped hollow body;

d) a body (50, 250, 350, 450, 550, 650) that is hollow in the longitudinal direction of the cartridges (30, 230, 330, 430, 530, 630) is arranged on the cartridge head (31, 231) as cartridge system head having an internal thread (51, 251, 451, 551, 651), whereby the internal diameter of the internal thread (51, 251, 451, 551, 651) is larger than the internal diameter of the internal hollow cylinder (20, 120, 220, 320, 420, 520, 620) or of the irregularly or regularly-shaped hollow body;

e) a continuous hollow space is formed from the hollow body (50, 250, 350, 450, 550, 650) having internal thread (51, 251, 451, 551, 651) to the cartridge floor (33, 333);

f) below the internal thread (51, 251, 451, 551, 651), a closure (60, 260, 360, 460, 560, 660) that can be shifted in longitudinal direction of the hollow space is arranged in press-fit manner in the internal hollow space;

g) the cartridges (30, 230, 330, 430, 530, 630) are closed through feed plungers (62, 162, 262, 362, 462, 562, 662);

h) the feed plungers (62, 162, 262, 362, 462, 562, 662) are connected to each other on the side facing away from the cartridge floor (33, 333) through at least one fin (65, 165) or a plate (695);

i) a rod (70) is situated in the internal hollow cylinder (20, 120, 220, 320, 420, 520, 620) or the internal irregularly- or regularly-shaped hollow body, and is arranged in longitudinal direction of the feed plungers (62, 162, 262, 362, 462, 562, 662), which is connected by one of its ends to the fins (65, 165) or the plate (695) and has a length at least equal to the length of the feed plungers (62, 162, 262, 362, 462, 562, 662);

j) the rod (70) is cogged on the side facing the cartridge head (31, 231), whereby the tips of the cogs are oriented in the direction of the cartridge floor (33, 333);

k) the cross-section of the rod (70) is smaller than the cross-section of the internal hollow cylinder (20, 120, 220, 320, 420, 520, 620) or of the internal irregularly- or regularly-shaped hollow body; and l) a flexible snap-in device (72) is arranged on the end of the internal hollow cylinder (20, 120, 220, 320, 420, 520, 620) or of the internal irregularly- or regularly-shaped hollow body on the side facing the cartridge floor (33, 333) and has a cross-section that is smaller than or equal to the cogged rod (70), and a dispensing tube (80, 280, 380, 480, 580) with an external thread (82, 282, 482, 582) that is arranged on the side facing away from the outlet opening (81, 281, 381, 481, 581), in which a static mixer (88, 388, 588) is situated in the internal space of the dispensing tube (80, 280, 380, 480, 580), in that a hollow cylinder (86, 286, 386, 486, 586) having a perforated jacket surface or a perforated irregularly-shaped or regularly-shaped hollow body is arranged on the side of the external thread (82, 282, 482, 582) facing away from the outlet opening (81, 281, 381, 481, 581).

The term, cartridge system, is understood to refer to cartridges that are made up of two, three, four, five or more cartridges (30, 230, 330, 430, 530, 630), whereby the individual cartridges (30, 230, 330, 430, 530, 630) are arranged to be parallel to each other. The cartridges (30, 230, 330, 430, 530, 630) can be cylinder-shaped hollow bodies. These are so-called side-by-side cartridges. The cartridges can already be filled with starting components for a mixing ware to be mixed, but can just as well be empty, i.e. may still need to be filled with content, e.g. cartridge inserts.

The shiftable closure (60, 260, 360, 460, 560, 660) preferably has a closed jacket surface.

The advantages of the cartridge system are that all openings (40, 240, 340, 440, 540, 640) in the cartridges (30, 230, 330, 430, 530, 630) are closed by just a single shiftable closure (60, 260, 360, 460, 560, 660) only. Said closure has a slightly larger cross-section than the mixing space (20, 120, 220, 320, 420, 520, 620). This means that the jacket surface of the shiftable closure (60, 260, 360, 460, 560, 660) is pressed against the internal wall of the mixing space (20, 120, 220, 320, 420, 520, 620) and/or the walls (21) thereof. When the shiftable closure (60, 260, 360, 460, 560, 660) is situated over the openings (40, 240, 340, 440, 540, 640) of the cartridges (30, 230, 330, 430, 530, 630), said openings are closed. In this context, the shiftable closure (60, 260, 360, 460, 560, 660) completely overlaps the openings (40, 240, 340, 440, 540, 640) in a manner such that sufficient closed jacket surface for sealing touches against the internal wall (21) of the mixing space (20, 120, 220, 320, 420, 520, 620). The sealing is attained through the contact pressure resulting from the tight contact of the jacket surface of the shiftable closure (60, 260, 360, 460, 560, 660) to the internal wall (21) of the mixing space (20, 120, 220, 320, 420, 520, 620).

Many common plastic materials in medicine, such as polypropylene, have only low coefficients of static friction and dynamic friction. This means that sliding processes can be made to proceed by the action of relatively small force in the case of tribological pairs made of such plastic materials. The shiftable closure (60, 260, 360, 460, 560, 660) can therefore be shifted by axial motion if suitable plastic materials are used. Through this means, it is feasible to move the shiftable body away from the openings (40, 240, 340, 440, 540, 640) of the cartridges (30, 230, 330, 430, 530, 630) and thus open the cartridges (30, 230, 330, 430, 530, 630). Therefore, when the shiftable closure (60, 260, 360, 460, 560, 660) moves axially, the openings (40, 240, 340, 440, 540, 640) of all cartridges (30, 230, 330, 430, 530, 630) can be opened simultaneously.

The cartridges (30, 230, 330, 430, 530, 630) are closed through feed plungers (62, 162, 262, 362, 462, 562, 662), whereby the feed plungers (62, 162, 262, 362, 462, 562, 662) are connected to each other through fins (65, 165) or a plate (695) on the side facing away from the cartridge floor (33, 333). This means that the feed plungers (62, 162, 262, 362, 462, 562, 662) form a unit and cannot be moved individually. This enables the pastes from all cartridges (30, 230, 330, 430, 530, 630) of the cartridge system to be expelled evenly. This feature is essential if the plungers are to be moved by direct application of compressed gas.

When the dispensing tube (80, 280, 380, 480, 580) is being screwed-in, the extension (86, 286, 386, 486, 586) moves along in the direction of the cartridge floor (33, 333). This causes a force to be applied to the shiftable closure (60, 260, 360, 460, 560, 660) in the direction of the cartridge floor (33, 333). As soon as the static friction between the jacket surface of the shiftable closure (60, 260, 360, 460, 560, 660) and the internal wall (21) of the mixing space (20, 120, 220, 320, 420, 520, 620) is overcome, the shiftable closure (60, 260, 360, 460, 560, 660) can move in the direction of the cartridge floor (33, 333). During this forced motion of the shiftable closure (60, 260, 360, 460, 560, 660) caused by the dispensing tube (80, 280, 380, 480, 580) being fastened, the openings (40, 240, 340, 440, 540, 640) of the cartridges (30, 230, 330, 430, 530, 630) are freed synchronously. In this context, the perforations and/or openings (85, 285, 385, 485, 585) of the extension (86, 286, 386, 486, 586) are situated over the openings (40, 240, 340, 440, 540, 640) of the cartridges (30, 230, 330, 430, 530, 630). Through this means, the internal spaces of the cartridges (30, 230, 330, 430, 530, 630) are connected to the internal space of the extension (86, 286, 386, 486, 586), which is provided as perforated hollow cylinder or perforated irregularly- or regularly-shaped hollow body. When the feed plungers (62, 162, 262, 362, 462, 562, 662) are moved in the direction of the cartridge system head (50, 250, 350, 450, 550, 650), pastes contained in the cartridges (30, 230, 330, 430, 530, 630) can enter through the freed openings (40, 240, 340, 440, 540, 640) into the internal space of the extension (86, 286, 386, 486, 586) and move through the static mixer (88, 388, 588) in the direction of the outlet opening (81, 281, 381, 481, 581) of the dispensing tube (80, 280, 380, 480, 580).

According to the invention, the shiftable closure (60, 260, 360, 460, 560, 660) is preferably provided as hollow cylinder, whereby it is particularly preferred for the hollow cylinder to be closed over the entire cross-section only on the side facing the cartridge head (31, 231). The termination of the closure (60, 260, 360, 460, 560, 660) thus formed, which may, for example, be a disc, prevents the pastes from spreading in the mixing space (20, 120, 220, 320, 420, 520, 620) in the direction of the cartridge floor (33, 333) when the pastes are expelled.

It is essential for the invention that the dispensing tube (80, 280, 380, 480, 580) is screwed by its fastening means (82, 282, 482, 582) into the fastening means (51, 251, 451, 551, 651) on the mixing space (20, 120, 220, 320, 420, 520, 620), whereby the perforated extension (86, 286, 386, 486, 586) that is arranged on the dispensing tube (80, 280, 380, 480, 580) or on the shiftable closure (60, 260, 360, 460, 560, 660) is thus moved in longitudinal direction of the mixing space (20, 120, 220, 320, 420, 520, 620) and thus the shiftable closure (60, 260, 360, 460, 560, 660) is shifted along the mixing space (20, 120, 220, 320, 420, 520, 620), whereby the openings (85, 285, 385, 485, 585) of the perforated extension (86, 286, 386, 486, 586) are slid over the openings (40, 240, 340, 440, 540, 640) of the cartridges (30, 230, 330, 430, 530, 630). This means that, synchronous to the dispensing tube (80, 280, 380, 480, 580) being fastened, the shiftable closure (60, 260, 360, 460, 560, 660) is shifted and thus the openings (40, 240, 340, 440, 540, 640) of the cartridges (30, 230, 330, 430, 530, 630) are freed, and the openings (85, 285, 385, 485, 585) of the perforated extension (86, 286, 386, 486, 586) simultaneously slide over the openings (40, 240, 340, 440, 540, 640) of the cartridges (30, 230, 330, 430, 530, 630) and thus open the cartridges (30, 230, 330, 430, 530, 630). The cartridges (30, 230, 330, 430, 530, 630) are opened synchronous to the insertion of the dispensing tube (80, 280, 380, 480, 580). This makes it virtually impossible for volatile paste components to exit from the cartridges (30, 230, 330, 430, 530, 630).

Being provided as a hollow cylinder with one closed side and an open side in the direction of the cartridge floor (33), the rod (70) can travel a maximal path during the motion of the feed plungers (62) in the direction of the cartridge head (31) in the first exemplary embodiment. For this purpose, the diameter of the tip of the rod (70) including the snap-in locking means (71) attached thereto is smaller than the internal diameter of the shiftable closure (60) that is provided as a hollow cylinder.

It is feasible just as well to provide the shiftable closure (60, 260, 360, 460, 560, 660) as a hollow body with an oval cross-section or a regular or irregular polygonal cross-section. It is feasible just as well to provide the shiftable closure (60, 260, 360, 460, 560, 660) as a massive body or as a body that can be assembled from multiple individual parts (460, 461, 486, 560, 580). The shiftable closure (60, 260, 360, 460, 560, 660) can be manufactured from one or more materials, depending on the requirements with regard to the chemical stability with respect to the pastes and the desired sliding properties.

According to the invention, pegs, fins or a ring can be arranged as retaining means (74, 274, 374) on the internal wall (21) of the mixing space (20, 120, 220, 320, 420, 520, 620). They limit the maximal axial shift of the shiftable closure (60, 260, 360, 460, 560, 660) in the direction of the cartridge floor (33) or in the direction of the outlet (322).

According to the invention, the perforated hollow body (86, 286, 386, 486, 586) serving as extension, in longitudinal direction of the cartridges (30, 230, 330, 430, 530, 630), is one length larger than or at least equal to the length of the openings (40, 240, 340, 440, 540, 640) of the cartridges (30, 230, 330, 430, 530, 630). This ensures that all of the openings (40, 240, 340, 440, 540, 640) of the cartridges (30, 230, 330, 430, 530, 630) can be freed upon the dispensing tube (80, 280, 380, 480, 580) being fastened. Thus, the entire cross-section of the openings (40, 240, 340, 440, 540, 640) can be freed.

Moreover, according to the invention, the retention means (74, 274, 374) are situated at a distance to the openings (40, 240, 340, 440, 540, 640) of the cartridges (30, 230, 330, 430, 530, 630) in longitudinal direction of the cartridges (30, 230, 330, 430, 530, 630) that is at least equal to the length of the extension (86, 286, 386, 486, 586) and/or of the closure (60, 260, 360, 460, 560, 660). The retention means (74, 274, 374) are required to ensure that the shiftable closure (60, 260, 360, 460, 560, 660) cannot be moved beyond what was required previously, when the cartridges (30, 230, 330, 430, 530, 630) were opened, upon the pastes being expelled. This means that the retention means (74, 274) also serve to prevent the formation of a useless dead volume.

The cartridges (30, 230, 330, 430, 530, 630) can comprise one or more slits (75) [that extend] from the cartridge floor (33, 333) to at least half of the cartridge length and are oriented such as to be parallel to the cartridge axis such that the mixing space walls (21) also comprise slits (75) that are oriented in longitudinal direction of the cartridges (30, 230, 330, 430, 530, 630) and are equal in length to the slits (75) of the cartridges (30, 230, 330, 430, 530, 630), whereby the number of slits (75) in the mixing space walls (21) is equal to the number of slits (75) in the cartridges (30, 230, 330, 430, 530, 630) and the slits (75) in the mixing space walls (21) are situated above the slits (75) of the cartridges (30, 230, 330, 430, 530, 630) such that the internal spaces of the cartridges (30, 230, 330, 430, 530, 630) and the mixing space (20, 120, 220, 320, 420, 520, 620) are connected to each other.

According to the invention, the fins (65, 66, 165) have a smaller cross-section than the slits (75). This means that the fins (65, 66, 165) can be moved through the slits (75) in the cartridges (30, 230, 330, 430, 530, 630) in the direction of the cartridge system head (50, 250, 350, 450, 550, 650) when the cartridges (30, 230, 330, 430, 530, 630) are squeezed out. The slits (75) serve as guidance for the fins (65, 66, 165) and thus for the feed plungers (62, 162, 262, 362, 462, 562, 662) during the motion towards the cartridge head (31, 231) upon squeezing.

The scope of the invention can also provide pegs (251) that are slanted on their upper side in the direction of the cartridge floor (33, 333) to be arranged in the cartridge system head (50, 250, 350, 450, 550, 650) as fastening means (51, 251) instead of the internal thread (51, 251, 451, 551, 651), and pegs (282) that are slanted on their underside to be arranged on the dispensing tube (80, 280, 380, 480, 580) instead of the external thread (82) such that the pegs (251) of the hollow body (250) and the pegs (282) of the dispensing tube (280) form a snap-in closure. Bayonet closures or retaining clamps are a fastening system that is a conceivable alternative to the threads (51, 251, 451, 551, 651) for fastening the dispensing tube (80, 280, 380, 480, 580) on the cartridge system head (50, 250, 350, 450, 550, 650).

A method for opening a cartridge system according to the invention is characterised in that the dispensing tube (80, 280, 480, 580) is attached by its fastening means (82, 282, 482, 582) to the fastening means (51, 251, 451, 551, 651) of the cartridge system head (50, 250, 450, 550, 650), whereby the extension (86, 286, 486, 586) arranged on the dispensing tube (80, 280, 480, 580) simultaneously rotates along in the direction of the cartridge floor (33) and moves in the direction of the cartridge floor (33) in the mixing space (20, 120, 220, 420, 520, 620), such that, in the process, the shiftable closure (60, 260, 460, 560, 660) is moved in the direction of the cartridge floor (33), whereby the openings (40, 240, 440, 540, 640) in the cartridge walls (32, 132, 232, 432) are opened and the internal spaces of the cartridges (30, 230, 430, 530, 630) are connected to the internal space of the mixing space (20, 120, 220, 420, 520, 620).

The cartridge system according to the invention is used for packaging, storage, and application of paste-shaped bone cements, dental multi-component preparations, adhesives, sealants, cosmetics, and food items. The multi-component cartridge system is particularly well-suited for storing and applying paste-shaped polymethylmethacrylate bone cements.

The features of the invention disclosed in the preceding description and in the claims, figures, and exemplary embodiments, can be essential for the implementation of the various embodiments of the invention both alone and in any combination.

LIST OF REFERENCE NUMBERS

1 Cartridge system
20, 120, 220, 320, 420, 520, 620 Mixing space
21 Mixing space wall
22, 322, 422, 622 Outlet opening
30, 230, 330, 430, 530, 630 Cartridge
31, 231 Cartridge head
32, 132, 232, 332, 432 Cartridge wall
33, 333 Cartridge floor
40, 240, 340, 440, 540, 640 Opening
50, 250, 350, 450, 550, 650 Cartridge system head
51, 251, 451, 551, 651 Fastening means on the cartridge system head
60, 260, 360, 460, 560, 660 Closure
62, 162, 262, 362, 462, 562, 662 Feed plunger
65, 165 Fin
66 Fin
70, 670 Rod
71 Snap-in locking means
72 Opposite snap-in locking means
74, 274, 374 Stop
75 Slit
76 Slit end
80, 280, 380, 480, 580 Dispensing tube
81, 281, 381, 481, 581 Dispensing tube tip
82, 282, 482, 582 Fastening means on the dispensing tube
85, 285, 385, 485, 585 Openings
86, 286, 386, 486, 586 Extension
88, 388, 588 Mixer
179 Jacketing
461 Closure part
690 Centring facility
691 Unlocking facility
693 Locking hooks
694 Locking step
695 Plate

What is claimed:

1. A cartridge system for mixing and applying a mixing ware comprising at least two cartridges that are arranged parallel to each other and are bound by cartridge heads, cartridge walls and cartridge floors of the at least two cartridges, and a mixing space having an outlet opening, wherein the at least two cartridges each comprise at least one opening in the cartridge walls that connects the at least two cartridges to the mixing space, and the at least two cartridges each comprise a feed plunger for expelling starting components of the mixing ware out of the at least two cartridges through the openings, wherein the openings of the at least two cartridges are located in the cartridge walls between interiors of the at least two cartridges and between the cartridge heads and cartridge floors of the at least two cartridges, wherein at least a portion of the mixing space is located between the at least two cartridges, wherein a closure, that is displaceable in the mixing space from a starting position to a final position, is arranged in the mixing space in a manner such that (i) the closure closes the openings of the at least two cartridges when the closure is located in the starting position and (ii) the openings of the at least two cartridges to the mixing space are opened, at least in part, when the closure is located in the final position, wherein the entire length of the closure is shiftable, within only the mixing space and in a longitudinal direction of the mixing space, from the starting position within the mixing space, adjacent to the openings of the at least two cartridges, towards the feed plungers to the final position within the mixing space.

2. The cartridge system according to claim 1, wherein the mixing space is a hollow body having hollow body walls, wherein the openings in the at least two cartridges extend through the hollow body walls into the mixing space.

3. The cartridge system according to claim 2, wherein the mixing space is arranged between the at least two cartridges, in a manner, such that regions of the cartridge walls and the hollow body wall are provided as a single part.

4. The cartridge system according to claim 1, wherein the mixing space is arranged parallel to the at least two cartridges.

5. The cartridge system according to claim 4, wherein the interior of the mixing space has a mobile rod arranged in parallel to the feed plungers and fixedly connected to the feed plungers through at least a fin or a plate, wherein the rod comprises a snap-in locking means on the side facing the outlet opening and an opposite snap-in locking means is attached in the mixing space that acts in concert with the snap-in locking means of the rod, in a manner, such that a motion of the rod out of the mixing space and therefore a motion of the feed plungers out of the at least two cartridges is significantly hampered or prevented.

6. The cartridge system according to claim 5, wherein the cartridge walls and/or the mixing space walls include at least one slit that starts at the cartridge floor and is arranged parallel to the cartridge axis, wherein a width of the slit or slits is sufficient to take up the fin or fins and the length of the slit or slits extends to at least half of the length of the cartridge.

7. The cartridge system according to claim 1, wherein the outlet opening is arranged in a cartridge system head and the cartridge system head comprises a fastening means for fastening a dispensing tube on an inside of the cartridge system head.

8. The cartridge system according to claim 1, wherein a limit stop, in a form of pegs or fins, is arranged in the mixing space and limits the motion of the closure in the mixing space and thus defines the final position of the closure.

9. The cartridge system according to claim 1, wherein the closure is arranged in the mixing space in a press-fit manner.

10. The cartridge system according to claim 1, wherein the feed plungers close the at least two cartridges in a sealed manner.

11. The cartridge system according to claim 1, wherein the closure is a compact body or a hollow body with one closed side.

12. A cartridge system for mixing and applying a mixing ware comprising at least two cartridges that are arranged parallel to each other, and a mixing space having an outlet opening, wherein the at least two cartridges each comprise at least one opening in cartridge walls that connects the at least two cartridges to the mixing space, and the at least two cartridges each comprise a feed plunger for expelling starting components of the mixing ware out of the at least two cartridges through the openings, wherein a closure, that has a length and is displacable in the mixing space from a starting position to a final position, is arranged in the mixing space in a manner such that (i) the closure closes the openings of the at least two cartridges when the closure is located in the starting position and (ii) the openings of the at least two cartridges to the mixing space are opened, at least in part, when the closure is located in the final position, wherein the at least two cartridges each comprise an interior having a length defined between a first end and a second end located opposite to the first end, wherein the openings in the cartridge walls and at least a portion of the mixing space is located between the interiors of the at least two cartridges at positions between the first and second ends of the interiors of the at least two cartridges, wherein, when located in the starting position, the closure is adjacent to the first ends of the interiors of the at least two cartridges, and further wherein, when located in the final position, more than half of the length of the closure is located at a position that is between the openings of the at least two cartridges and the second ends of the interiors of the at least two cartridges.

13. A cartridge system for mixing and applying a mixing ware comprising two cartridges that are arranged parallel to each other, and a mixing space having an outlet opening, wherein the cartridges each comprise at least one opening in cartridge walls that connects the cartridges to the mixing space, and the cartridges each comprise a feed plunger for expelling starting components of the mixing ware out of the cartridges through the openings wherein a closure, that can be displaced in the mixing space, is arranged in the mixing space in a manner such that it closes the openings of the cartridges in a starting position and in that the openings to the mixing space are opened, at least in part, in a final position of the closure, wherein the closure can be displaced from a starting position to a final position, wherein the mixing space is arranged parallel to the cartridges, wherein the interior of the mixing space has a mobile rod arranged in parallel to the feed plungers and fixedly connected to the feed plungers through at least a fin or a plate, wherein the rod comprises a snap-in locking means on the side facing the outlet opening and an opposite snap-in locking means is attached in the mixing space that acts in concert with the snap-in locking means of the rod, in a manner, such that a motion of the rod out of the mixing space and therefore a motion of the feed plungers out of the cartridges is significantly hampered or prevented.

* * * * *